US011028580B2

(12) United States Patent
Burt et al.

(10) Patent No.: US 11,028,580 B2
(45) Date of Patent: Jun. 8, 2021

(54) DECK FRAME WITH INTEGRAL ATTACHMENT TABS

(71) Applicant: Fortress Iron, LP, Garland, TX (US)

(72) Inventors: Kevin T. Burt, Dallas, TX (US); Matthew Carlyle Sherstad, Dallas, TX (US); Kevin B. Flatt, Garland, TX (US); Aaron Jesiolowski, Garland, TX (US); Geoff T. Luczycki, Garland, TX (US)

(73) Assignee: Fortress Iron, LP, Garland, TX (US)

( * ) Notice: Subject to any disclaimer, the term of this patent is extended or adjusted under 35 U.S.C. 154(b) by 0 days.

(21) Appl. No.: 15/990,351

(22) Filed: May 25, 2018

(65) Prior Publication Data

US 2019/0360202 A1 Nov. 28, 2019

(51) Int. Cl.
*E04B 5/10* (2006.01)
*E04C 3/07* (2006.01)
(Continued)

(52) U.S. Cl.
CPC ..... *E04B 5/10* (2013.01); *E04B 1/003* (2013.01); *E04B 1/2403* (2013.01); *E04C 3/07* (2013.01);
(Continued)

(58) Field of Classification Search
CPC ..... E04B 5/10; E04B 1/003; E04B 1/2403; E04B 2001/2466; E04B 2001/2406;
(Continued)

(56) References Cited

U.S. PATENT DOCUMENTS 2,106,084 A * 1/1938 Coddington ..... E04B 1/2403 52/376
2,744,590 A * 5/1956 Butts ..... E04B 5/14 52/645
(Continued)

FOREIGN PATENT DOCUMENTS

| | | |
|---|---|---|
| JP | 2004339923 | 12/2004 |
| WO | WO-2004/022875 | 3/2004 |
| WO | WO-2018/067712 | 4/2018 |

OTHER PUBLICATIONS

International Search Report and Written Opinion for PCT/US2017/055158 dated Jan. 23, 2018 (15 pages).
(Continued)

*Primary Examiner* — Brian D Mattei
*Assistant Examiner* — Charissa Ahmad
(74) *Attorney, Agent, or Firm* — Foley & Lardner LLP; John J. May

(57) ABSTRACT

A deck frame includes at least one perimeter support member that has a joist support wall, a web wall extending perpendicularly from the joist support wall, and an overhang wall extending perpendicularly from the web wall. The web wall includes a plurality of spaced apart joist attachment features. Each attachment feature includes a slot defined by the web wall, a first tab extending from a first perimeter edge of the slot at a first angle with respect to the web wall, and a second tab extending from a second perimeter edge of the slot opposite the first perimeter edge in a first direction and forming a second angle with respect to the web wall. The first tab is disposed spaced apart from the second tab in a second direction orthogonal to the first direction.

18 Claims, 17 Drawing Sheets

(51) Int. Cl.

| | |
|---|---|
| ***E04B 1/00*** | (2006.01) |
| ***E04B 1/24*** | (2006.01) |
| *E04C 3/06* | (2006.01) |
| *E04C 3/04* | (2006.01) |

(52) U.S. Cl.
CPC ..... *E04B 2001/2415* (2013.01); *E04B 2001/2466* (2013.01); *E04C 3/065* (2013.01); *E04C 2003/0473* (2013.01); *E04C 2003/0482* (2013.01)

(58) Field of Classification Search
CPC ..... E04B 2001/2421; E04B 1/585; E04B 2001/5856; E04C 3/07; E04C 2003/0482
See application file for complete search history.

(56) References Cited

U.S. PATENT DOCUMENTS 3,592,493 A * 7/1971 Goose ..... B62D 33/044 403/247
3,751,870 A 8/1973 Vesei
3,908,328 A * 9/1975 Nelsson ..... E04B 2/825 29/897.3
3,945,741 A 3/1976 Wendt
4,114,861 A * 9/1978 Long ..... E04H 17/1413 248/219.4
4,197,952 A * 4/1980 De Fouw ..... A47B 47/021 211/191
4,250,679 A * 2/1981 Burg ..... A47B 57/40 52/653.2
4,560,301 A * 12/1985 Gilb ..... B21D 53/38 403/232.1
4,596,101 A * 6/1986 Brinker ..... E04B 1/2604 52/317
4,608,801 A * 9/1986 Green ..... E04B 5/14 52/664
4,660,799 A 4/1987 Butland
4,894,967 A * 1/1990 Morton ..... E04B 7/00 228/182
5,004,369 A * 4/1991 Young ..... E04B 1/2612 403/232.1
5,189,857 A * 3/1993 Herren ..... E04B 2/58 52/317
5,190,268 A * 3/1993 Espinueva ..... E04H 17/1421 256/65.01
5,217,317 A * 6/1993 Young ..... E04B 1/2612 403/14
5,274,973 A * 1/1994 Liang ..... E04B 2/58 52/243
5,596,859 A * 1/1997 Horton ..... E04B 2/7453 52/481.1
5,657,596 A 8/1997 Powers, III
5,857,306 A 1/1999 Pellock
5,956,916 A 9/1999 Liss
D423,325 S * 4/2000 Liss ..... E04B 2/7457 D8/349
6,167,675 B1 * 1/2001 LeBlanc ..... E04B 5/12 403/232.1
6,176,053 B1 1/2001 St. Germain
6,301,854 B1 10/2001 Daudet et al.
6,332,299 B1 * 12/2001 Stewart, III ..... E04B 1/2608 52/506.05
6,418,694 B1 7/2002 Daudet et al.
6,427,416 B1 8/2002 Rassel
D463,575 S * 9/2002 Daudet ..... D25/61
6,536,179 B2 3/2003 Little
6,691,478 B2 2/2004 Daudet et al.
6,691,487 B2 2/2004 Daudet
6,705,056 B2 * 3/2004 Tollenaar ..... E04B 2/7457 52/317
6,761,005 B1 7/2004 Daudet et al.
6,843,035 B1 * 1/2005 Glynn ..... E04B 2/7457 52/481.1
7,127,862 B2 10/2006 Saldana
7,134,252 B2 * 11/2006 Thompson ..... E04B 1/26 52/712
7,240,459 B2 7/2007 Daudet et al.
7,257,930 B2 * 8/2007 Aldykiewicz, Jr. ..... E04F 15/04 428/343
7,451,575 B2 11/2008 Hall et al.
7,735,294 B2 * 6/2010 Moody ..... E04C 3/292 29/897.31
7,856,786 B2 * 12/2010 Beck ..... E04B 1/24 52/236.3
7,975,446 B2 7/2011 Hall et al.
8,011,160 B2 9/2011 Rice
8,424,266 B2 * 4/2013 Edmondson ..... E04B 2/7412 52/650.1
D730,545 S * 5/2015 Stauffer ..... D25/133
9,777,479 B2 10/2017 Rice
9,932,734 B1 * 4/2018 Winter ..... E04B 1/2403
10,132,074 B2 * 11/2018 Pace ..... E04H 6/025
10,370,842 B2 * 8/2019 Wesney ..... E04B 1/2612
2002/0078645 A1 6/2002 Meyer
2004/0200172 A1 * 10/2004 Beck ..... E04B 1/24 52/506.03
2005/0188638 A1 * 9/2005 Pace ..... E04B 5/29 52/414
2006/0048470 A1 * 3/2006 Edmondson ..... E04B 1/24 52/274
2006/0091372 A1 * 5/2006 Rosian ..... E04F 11/1834 256/65.01
2006/0096229 A1 5/2006 Serpico et al.
2006/0185312 A1 8/2006 Weeks
2006/0191236 A1 * 8/2006 Surowiecki ..... E04B 2/763 52/481.1
2008/0022624 A1 1/2008 Hanson et al.
2008/0066409 A1 * 3/2008 Pruitt ..... E04B 1/003 52/414
2008/0237421 A1 * 10/2008 Szpotowski ..... E04B 1/2612 248/222.51
2008/0256884 A1 10/2008 Clarizia et al.
2009/0139176 A1 * 6/2009 Schroeder, Sr. ..... E04B 5/10 52/656.1
2012/0297710 A1 11/2012 Klein
2012/0297724 A1 * 11/2012 Pope ..... E04B 1/2604 52/702
2013/0139465 A1 6/2013 Kuryk et al.
2014/0144098 A1 * 5/2014 Nicholls ..... E04B 1/2612 52/702
2016/0002934 A1 1/2016 Morsching
2016/0186424 A1 * 6/2016 Meyer ..... E04B 1/24 52/702
2018/0094432 A1 4/2018 Burt et al.

OTHER PUBLICATIONS

Extended European Search Report on EP Application No. 17859125.1, dated Apr. 22, 2020, 8 pages.

* cited by examiner

DECK FRAME WITH INTEGRAL ATTACHMENT TABS

CROSS-REFERENCE TO RELATED APPLICATIONS

This application is related to U.S. patent application Ser. No. 15/725,003, filed on Oct. 4, 2017, entitled "Deck Framing System," which claims priority to U.S. Provisional Patent Application Ser. No. 62/404,616, filed on Oct. 5, 2016, the disclosures of which are hereby incorporated by reference.

TECHNICAL FIELD

The present disclosure relates to construction materials, and more particularly to a deck framing system formed of light gauge steel components.

BACKGROUND

Most outdoor deck frames are assembled using conventional building techniques and are typically formed of treated lumber. However, deck frames made of light gauge steel are an option for a sturdy and durable outdoor deck. Steel frames supporting a deck surface made of composite material, as opposed to natural wood, may be particularly durable. An example deck frame formed of light gauge steel is disclosed in U.S. Pat. No. 6,691,478 to Daudet et al. filed on May 14, 2002, entitled "Joist Support Apparatus," which is hereby incorporated by reference. Daudet discloses a steel deck frame with rim joists that include spaced apart attachment features. Each attachment feature includes a single tab. In assembling the deck frame, the single tab is secured to a web wall of a floor support joist that has a generally c-shape in profile.

SUMMARY

Embodiments of the present disclosure include a deck framing system formed of light gauge steel. The thickness of the light gauge steel components may be different among particular components depending on the load carried by the particular component and depending on the forming method for fabrication of the particular component.

An embodiment of the deck frame includes at least one perimeter support member that has a joist support wall, a web wall extending perpendicularly from the joist support wall, and an overhang wall extending perpendicularly from the web wall. The web wall includes a plurality of spaced apart joist attachment features. Each attachment feature includes a slot defined by the web wall, a first tab extending from a first perimeter edge of the slot at a first angle with respect to the web wall, and a second tab extending from a second perimeter edge of the slot opposite the first perimeter edge in a first direction and forming a second angle with respect to the web wall. The first tab is disposed spaced apart from the second tab in a second direction orthogonal to the first direction.

According to an alternate embodiment, each joist attachment feature includes a second pair of tabs extending from the slot. The second pair of tabs may be horizontal tabs that are shorter than the first pair of tabs, which may be vertical tabs.

According to one embodiment, the deck frame includes a plurality of floor support joists that each has a first lateral wall and a second lateral wall disposed opposite the first lateral wall. For each joist, the first tab is configured to be secured to the first lateral wall and the second tab is configured to be secured to the second lateral wall. According to an alternate embodiment, each one of the second pair of tabs is configured to be received in an opening of an end of a floor support joist.

Technical advantages of a light gauge steel deck framing system according to the teachings of the present disclosure include a simplified fabrication and assembly where the floor support joists are secured to the perimeter support members using tabs that are integral to the perimeter support members. The spacing of the tabs supports receiving a tubular floor support joists between them. The attachment features of the perimeter support members are efficiently formed by punching and bending from a web wall of a blank of light gauge steel.

Other technical advantages will be readily apparent to one of ordinary skill in the art from the following figures, descriptions, and claims. Moreover, while specific advantages have been described above, various embodiments may include all, some, or none of the enumerated advantages.

BRIEF DESCRIPTION OF THE DRAWINGS

A more complete understanding of the present invention may be acquired by reference to the following Detailed Description when taken in conjunction with the accompanying Drawings wherein.

DETAILED DESCRIPTION OF THE DRAWINGS

Figure 1A:
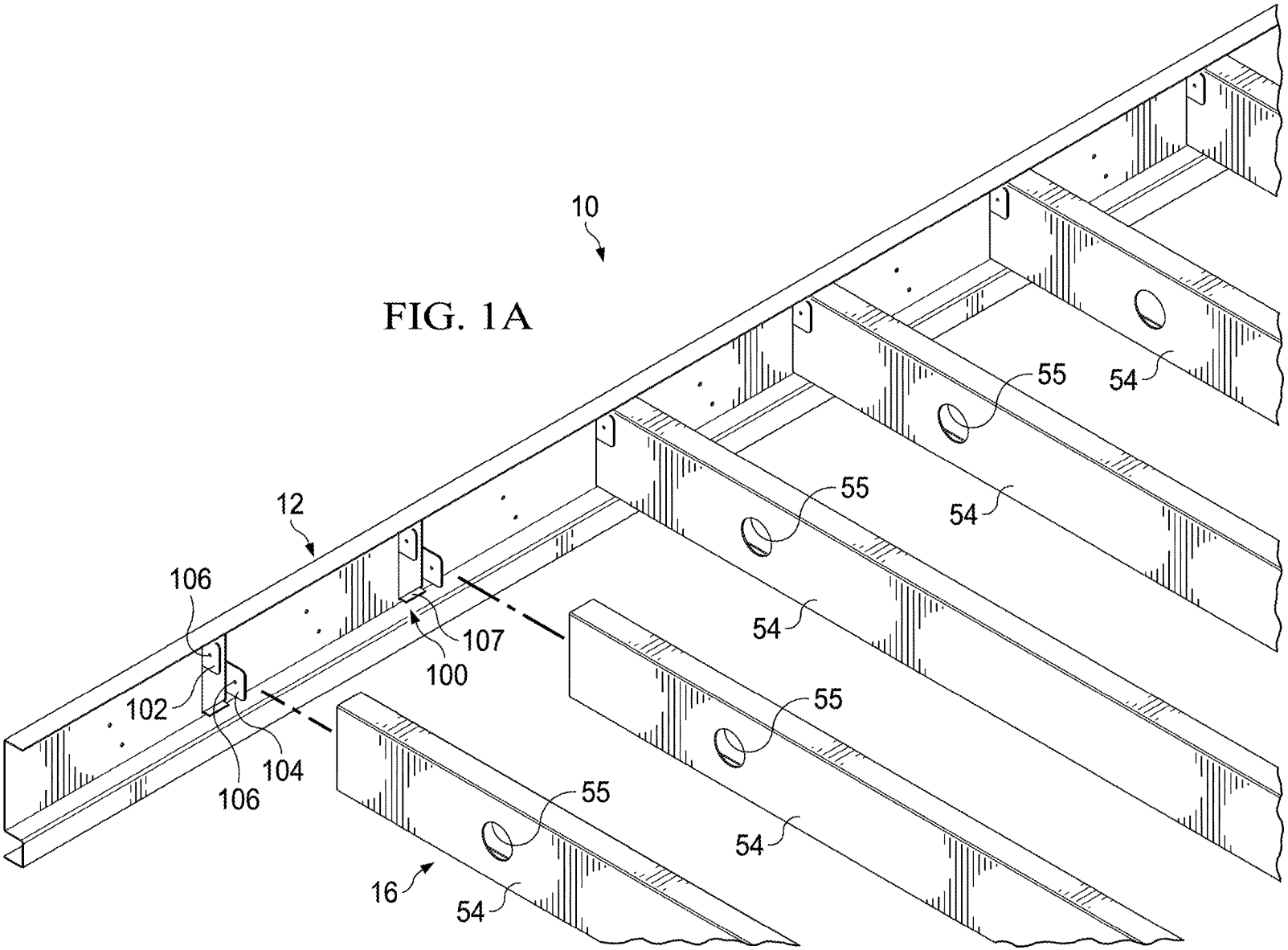
FIGS. 1A-1C are isometric, partially exploded views of a deck framing system with certain components exploded to better illustrate the assembly of the system according to an embodiment of the present disclosure.
Figure 1B:
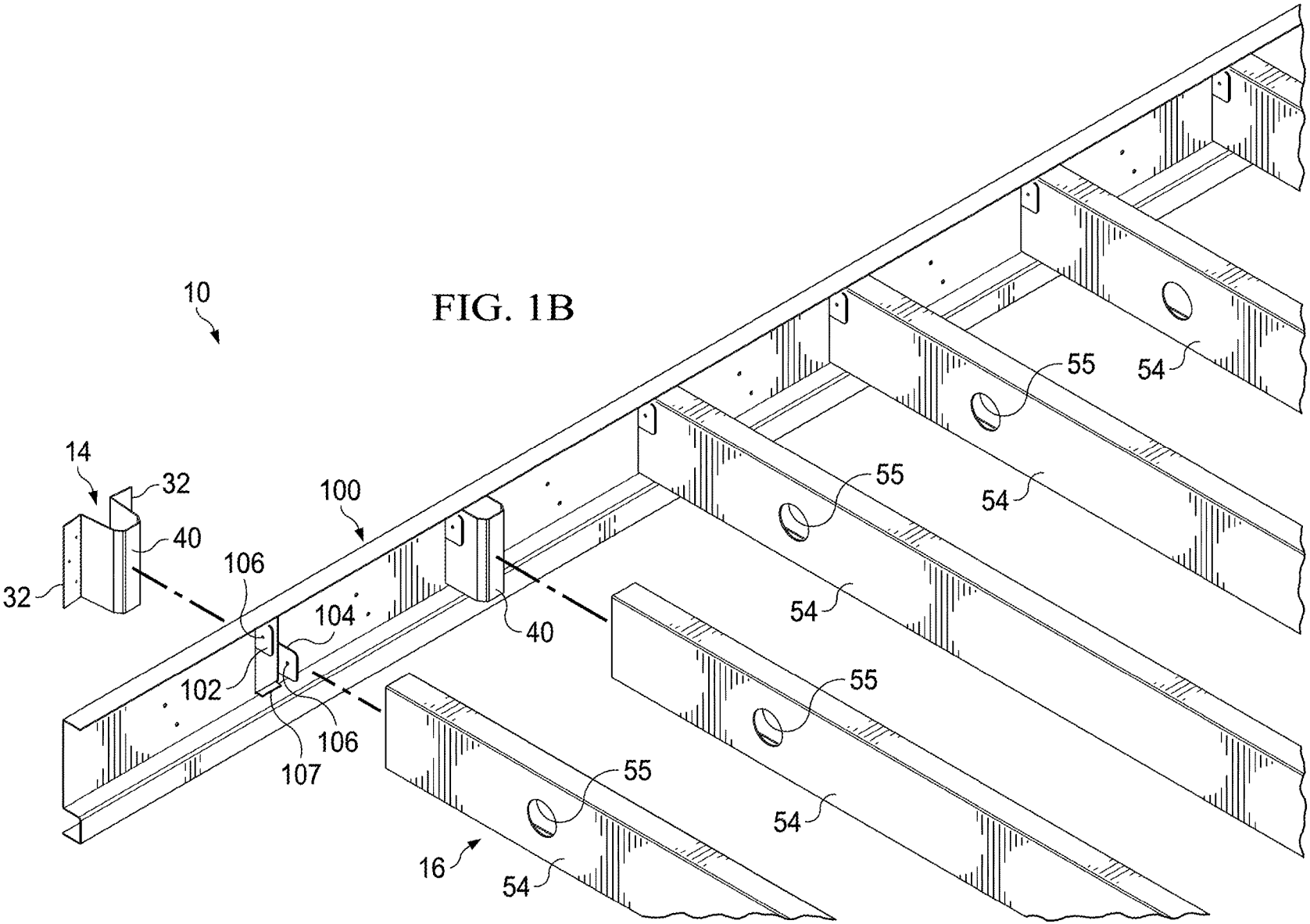
Figure 1C:
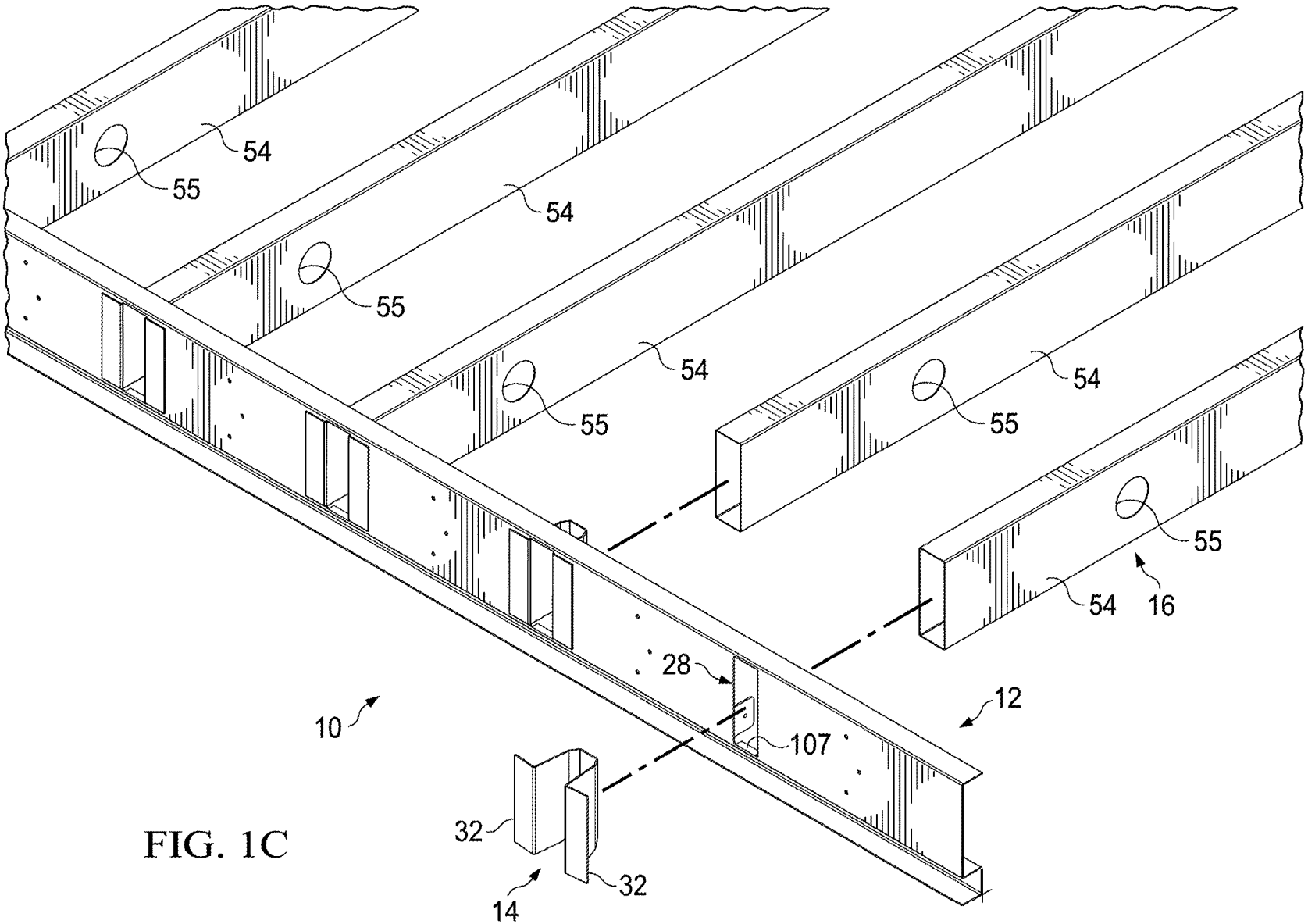

FIGS. 1A-1C are perspective views of a portion of a deck framing system 10 according to embodiments of the present disclosure. The deck framing system 10 includes features that increase ease of assembly of the deck framing system 10 and increase structural strength of individual components and thereby allow for less material to be used to frame a deck, such as an outdoor deck or patio. According to certain embodiments, the deck framing system is made of a light gauge steel. For example, the light gauge steel may be galvanized steel with a thickness in the range of 0.05-0.10 inches, for example 0.08 inches.

The deck framing system 10 includes a plurality of perimeter joist support members. One perimeter joist support member is a ledger 12 that supports ends of a plurality of joists 16, for example floor support joists. The ledger 12 includes a plurality of joist attachment features 100, as described in more detail below. According to one embodiment, each of the joist attachment features 100 receives a joist bracket 14 (also referred to as a square joist bracket 14 because it supports the joists 16 perpendicularly to the ledger 12). Each of the ledger 12, the joist brackets 14, and the joists 16 are formed of light gauge steel, for example galvanized steel with a thickness in the range of 0.05-0.10 inches, for example 0.08 inches. An end of the joists 16 opposite the ledger 12 is attached to a rim joist, as described in more detail below, or other support structure that is known in the art.

Reference is now made to FIGS. 2A-2F, which illustrate various views of embodiments of the ledger 12. The ledger 12 has a generally s-shaped profile. The s-shape is generally formed by an upper u-shaped portion 18 and a lower u-shaped portion 20. A joist support wall 22 is disposed generally horizontal and forms a lower part of the upper u-shaped portion 18 and an upper part of the lower u-shaped portion 20. The upper u-shaped portion 18 includes an overhang 24, a web wall 26 extending downward from the overhang wall 24 and the joist support wall 22 opposite the web wall 26 from the overhang wall 24. An opening of the "u" of the upper u-shaped portion 18 faces opposite an opening of the "u" of the lower u-shaped portion 20.

Each attachment feature 100 includes a slot 28 and a pair of vertical attachment tabs, and alternatively each attachment feature 100 may include a pair of horizontal attachment tabs. The attachment features 100 are spaced apart along a length of the ledger 12. Any suitable distance of separation of adjacent attachment features is contemplated by this disclosure. According to one embodiment, the attachment features 100 are separated approximately twelve inches to support floor support joists 16 that are spaced apart approximately twelve inches. In an alternative embodiment, the joist attachment features 100 are spaced apart 8-24 inches, for example approximately 16 inches.

Each attachment feature 100 includes a slot 28, an upper vertical attachment tab 102, and a lower vertical attachment tab 104. In addition to the vertical attachment tabs 102, 104, according to one embodiment, each attachment feature 100 may also include a lower horizontal tab 107 and an upper horizontal tab 109. As discussed in more detail below, the horizontal attachment tabs 107, 109 are received in an opening in a tubular-shaped floor support joist 16. The horizontal tabs 107, 109 prevent unwanted rotation of the floor support joist when the upper and lower vertical attachment tabs 102, 104 are secured to the floor support joist 16.

Figure 2A:
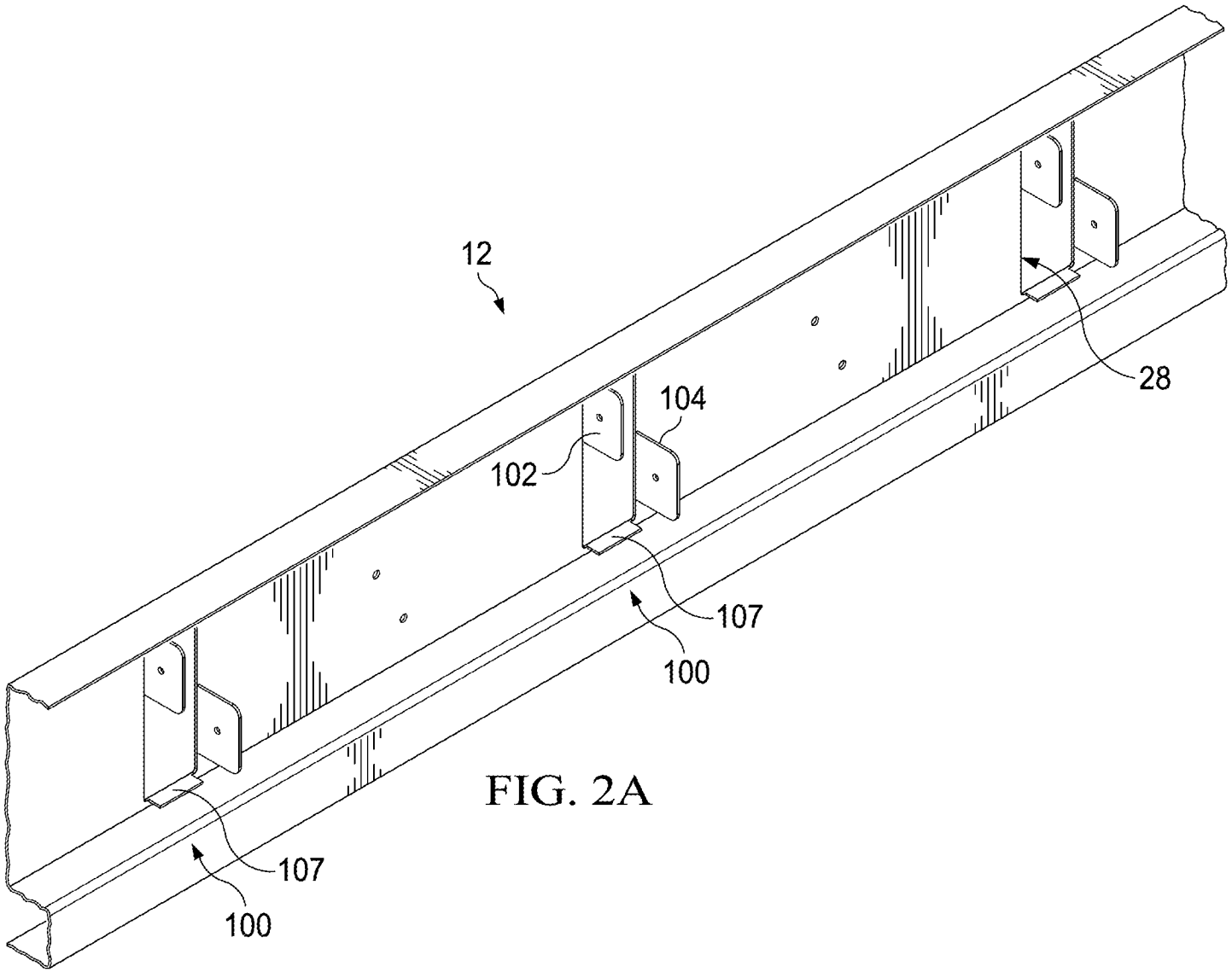
FIGS. 2A-2F are various views of a tabbed ledger of the deck framing system according to embodiments of the present disclosure.
Figure 2B:
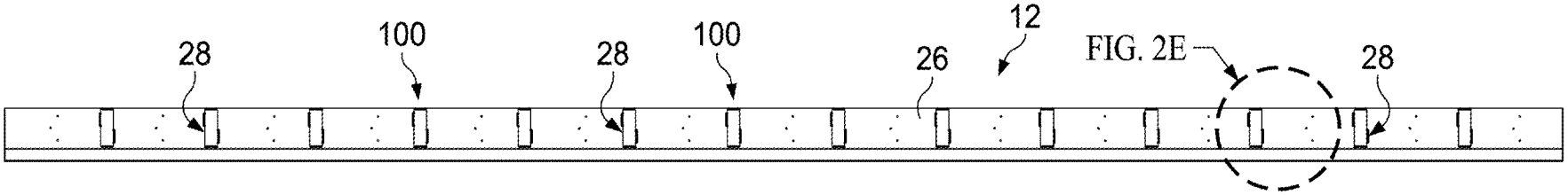
Figure 2D:
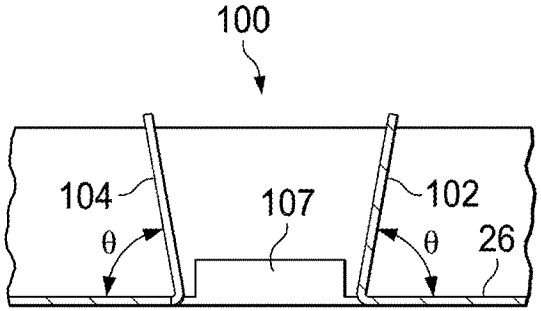
Figure 2C:
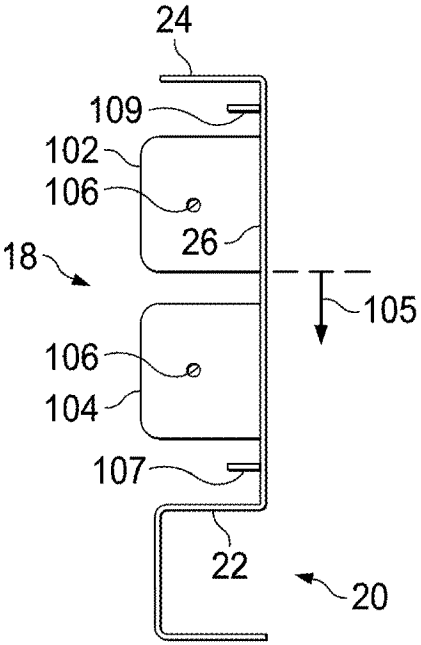
Figure 2F:
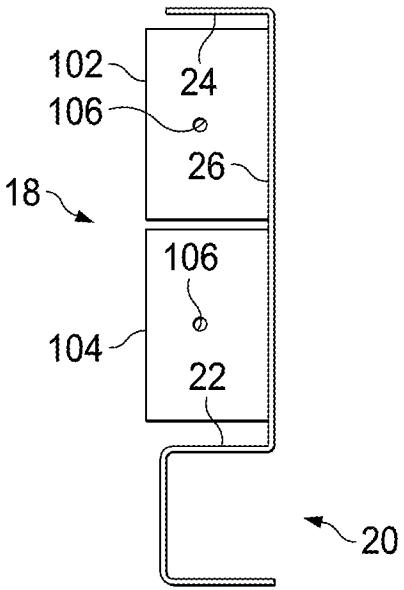
Figure 2E:
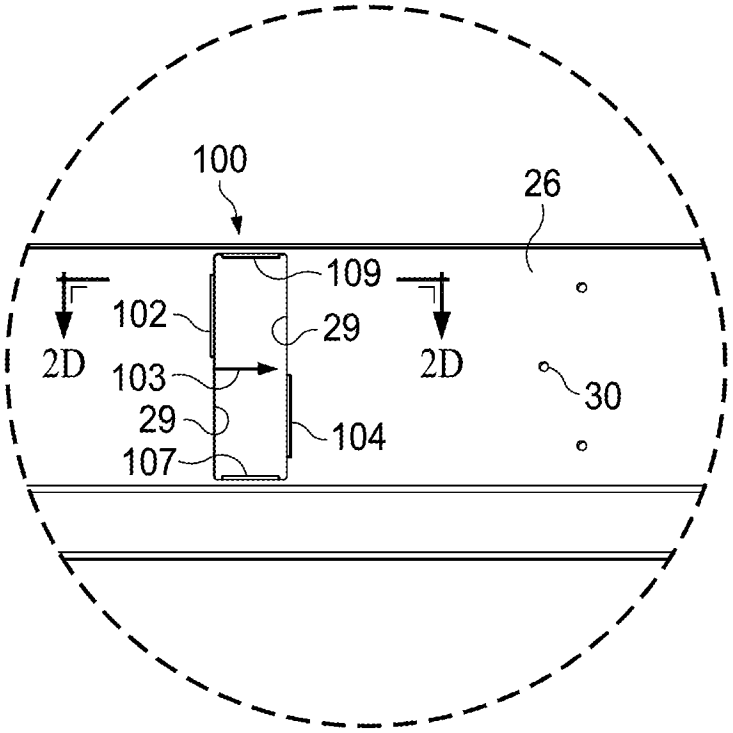

FIG. 2F shows a side, elevation view of an embodiment of the ledger 12 without the horizontal tabs 107, 109. FIGS. 2A-2E are various views of an embodiment of the ledger 12 that includes the horizontal tabs 107, 109.

The slot 28 is defined by a pair of opposed lateral edges 29 and a pair of opposed upper and lower edges. The upper vertical attachment tab 102 extends from one lateral edge 29 on one side of the slot 28, and the lower vertical attachment tab 104 extends from the other lateral edge 29, opposite the first lateral edge, of the slot 28. The upper vertical attachment tab 102 is disposed spaced apart from the lower vertical attachment tab 104 in a first direction 103. The upper vertical attachment tab 102 has a length measured from the web wall 26 that is generally equal to the width of the slot 28 and a height that is generally equal to half the height of the slot 28. The lower vertical attachment tab 104 also has a length that is generally equal to the width of the slot 28 measured from the web wall 26 and a height that is generally equal to half the height of the slot 28. The lower vertical attachment tab 104 is disposed spaced apart from the upper attachment tab 102 in a second direction 105.

For example, upper vertical attachment tab 102 may be spaced apart from lower vertical attachment tab 104 approximately a distance of 0.05-0.5 inches, for example 0.35 inches, which corresponds to a dimension of a shearing tool used to form the sheet metal. According to one embodiment, the upper and lower vertical attachment tabs 102, 104 have a height of 1-3 inches, for example approximately 2.2 inches, and a length extending from the web wall 26 of 1-3 inches, for example approximately 2.2 inches.

According to an alternate embodiment that includes lower and upper horizontal tabs 107, 109, a length of the lower horizontal tab 107 together with the height of the lower vertical attachment tab 102 equals approximately half the height of the slot 28. For example, the height of the lower vertical attachment tab 102 is approximately 1.4 inches and the length of the lower horizontal tab 107 is approximately 0.3 inches. The dimensions of the slot 28 and the attachment tabs 102, 104 are selected to accommodate a width of a floor support joist 16.

According to one embodiment, the lower horizontal tab 107 extends from the lower edge of the slot 28, and the upper horizontal tab 109 extends from the upper edge of the slot 28. The horizontal tabs 107, 109 may extend 0.2-0.6 inches from the web wall 26, for example 0.3 inches. The distance of extension of the horizontal tabs 107, 109 is sufficient such that the tubular joists 16 receive the tabs 107, 109 within an end opening, and the tabs 107, 109 will not unintentionally slip out and disengage from the floor joist 16. The length of the horizontal tabs 107, 109 is also at least partly determined by the height of the slot 28 and the dimensions of the other elements of the attachment features 100 (i.e. lower and upper horizontal attachment tabs 102, 104), which are formed from the web wall 26 that is removed and/or bent to form the slot 28.

The slots 28 are generally rectangular and have a long dimension that is approximately equal to but slightly less than a height of the web wall 26, for example, the height of the web wall 26 may be approximately six inches and the height of the slots 28 may be 3.5-5.5 inches, for example approximately 4.6 inches. The width of the slot 28 may be 2-4 inches, for example approximately 2.3 inches. The slots 28 are equally spaced apart from each other along the length of the web wall 26. In one embodiment, the slots 28 are approximately twelve inches from a center of one slot 28 to a center of an adjacent slot 28. However, any spaced apart dimension suitable for supporting a particular type of deck material and expected load is contemplated by the present disclosure. For example, slots 28 and therefore joists 16 may be spaced apart 8-24 inches, for example 16 inches.

In one embodiment, the web wall 26 has a height of approximately 6 inches, a slot 28 with a height of approximately 6 inches, and two vertical attachment tabs 102, 107. According to alternate embodiments, a web wall 26 may have a height greater than six inches, for example 8, 10, or 12 inches. A web wall 26 with a greater height may support a slot 28 with a greater height, and thereby may include more than two vertical attachment tabs 102, 104. For example, a web wall having a height of 10 inches may include a slot 28 having a height of approximately 10 inches. More than one vertical attachment tab, for example one vertical attachment tab may extend from one side of the slot 28, and two vertical attachment tabs may extend from the other side of the slot 28. The one attachment tab is disposed vertically between the two attachment tabs on the other side of the slot 28. Similarly, a 12 inch tall web wall 26 and slot 28 may support four vertical attachment tabs, two on each side of the slot 28, in a vertically staggered arrangement. This disclosure contemplates ledgers 12 having other sizes of web walls 26 and slots 28, for example, 8 inches or more than 12 inches or less than 6 inches. A ledger 12 with a larger web wall 26 supports correspondingly taller joists 16, and thereby the load that can be carried by the deck frame 10 is also increased.

The ledger 12 is attached to a structure, such as a foundation, bricks, wall studs, and the like of a home. According to certain embodiments, a suitable fastener, such as a screw is received through a preformed hole 30 in the web wall 26. Sets of three preformed holes 30 are located along the length of the web wall 26 to ensure that the ledger is tightly secured to the structure. A set of three holes 30 is spaced apart from an adjacent set of three holes 30 a predetermined distance, for example 12 or 16 inches, which may correspond to a spacing of the floor support joists 16. According to certain embodiments, a center hole 30 may be slightly offset, for example offset one inch, from vertical alignment with the other two preformed holes 30, which are vertically aligned with each other. The aligned two holes of the set of three holes 30 may be generally centered between two adjacent joist attachment features 100. The offset hole configuration may avoid creating a stress concentration area in the location of the preformed holes 30 and more evenly distribute loading stresses across the length of the ledger 12. Each of the preformed holes 30 may have any suitable diameter for receiving an appropriate fastener. For example, each of the preformed holes has a diameter in a range of 0.1-0.5 inches, such as 0.25 inches.

The lower u-shaped portion 20 provides an area underneath the joists 16 to run electrical wiring and the like and provides clearance beneath the joists 16. The lower u-shaped portion 20 also increases the strength of the ledger 12 and also provides a spring force when the ledger 12 is loaded.

The ledger 12 may be generally formed by sheet metal forming methods known in the art, such as roll forming, brake forming, or otherwise bending a flat piece of light gauge steel having a thickness in a range of 0.05-0.10 inches, for example 0.08 inches, in to the s-shape profile and removing material from the steel to form the slots 28 by, for example, stamping to shear the portion of the steel to be removed. The portions displaced from the slots 28 are bent away from the web wall 26 to form the upper and lower vertical attachment tabs 102, 104, and in one embodiment, the horizontal tabs 107, 109. According to one embodiment, the vertical attachment tabs 102, 104 are bent at least 90 degrees away from the web wall 26. For example, each vertical attachment tab 102, 104 is bent an angle θ from the slot 28. In one embodiment 0 is in a range of 60°-90°, for example approximately 80°. Clearance is provided between the attachment tabs 102, 104 to receive the full width of the floor support joist 16, for example approximately two inches. The horizontal tabs 107, 109 are bent any suitable angle, for example, approximately 90° from the web wall 26.

The holes 30 and the fastener holes 106 may or may not be preformed in the web wall 26. A height of the s-shaped ledger 12 is approximately eight inches. The ledger 12 may be formed in any suitable length, for example the ledger 12 may be 20 feet in length.

According to one embodiment as shown in FIG. 1A, a joist 16 is received between an upper attachment tab 102 and a lower attachment tab 104. The joist 16 is supported by the joist support wall 22. Each of the attachment tabs 102, 104 may include the preformed fastener hole 106. A suitable fastener, such as a screw is received through each fastener hole 106 to secure the tab 102 to the lateral walls 54 of the joists 16 and the tabs 104 to the opposite lateral wall 54 of the joists 16.

According to an alternate embodiment, the lower horizontal tab 107 and the upper horizontal tab 109 are each received within an opening in an end of the joist 16. The horizontal tabs 107, 109 fit snuggly within the opening to further stabilize the attachment of the joist 16 with the ledger 12. Contact between the inner surfaces of the lateral walls 54 of the joists 16 with the lower and upper horizontal tabs 107, 109 inhibit a tendency for the joists 16 to rotate as the lower and upper vertical attachment tabs 102, 104 are secured to the lateral walls 54 of the joist 16. Thus, the presence of the horizontal tabs 107, 109 may make it easier for an installer to attach the upper and lower vertical attachment tabs 104, 102 to each joist 16.

According to an alternate embodiment, as shown in FIGS. 1B and 1C, a joist support bracket 14 is received in a slot 28. An end of the joist 16 is received over a joist support portion 34 of the joist support bracket 14, as described below. A first lateral wall 54 of the joist 16 is disposed between the upper vertical attachment tab 102 and the joist support bracket 14, and a second lateral wall 54 opposite the first lateral wall 54 of the joist 16 is disposed between the lower vertical attachment tab 104 and the joist support bracket 14. A suitable fastener (not shown) is received through the fastener hole 106 (if present) in each vertical attachment tab 102, 104 and into the lateral walls 54 and into the joist support bracket 104. According to an alternate embodiment, the fastener holes 106 are not preformed and the fastener is selected to penetrate the attachment tabs 102, 104. The horizontal tabs 107, 109 may or may not be present when used with the joist support bracket 14.

Figure 3:
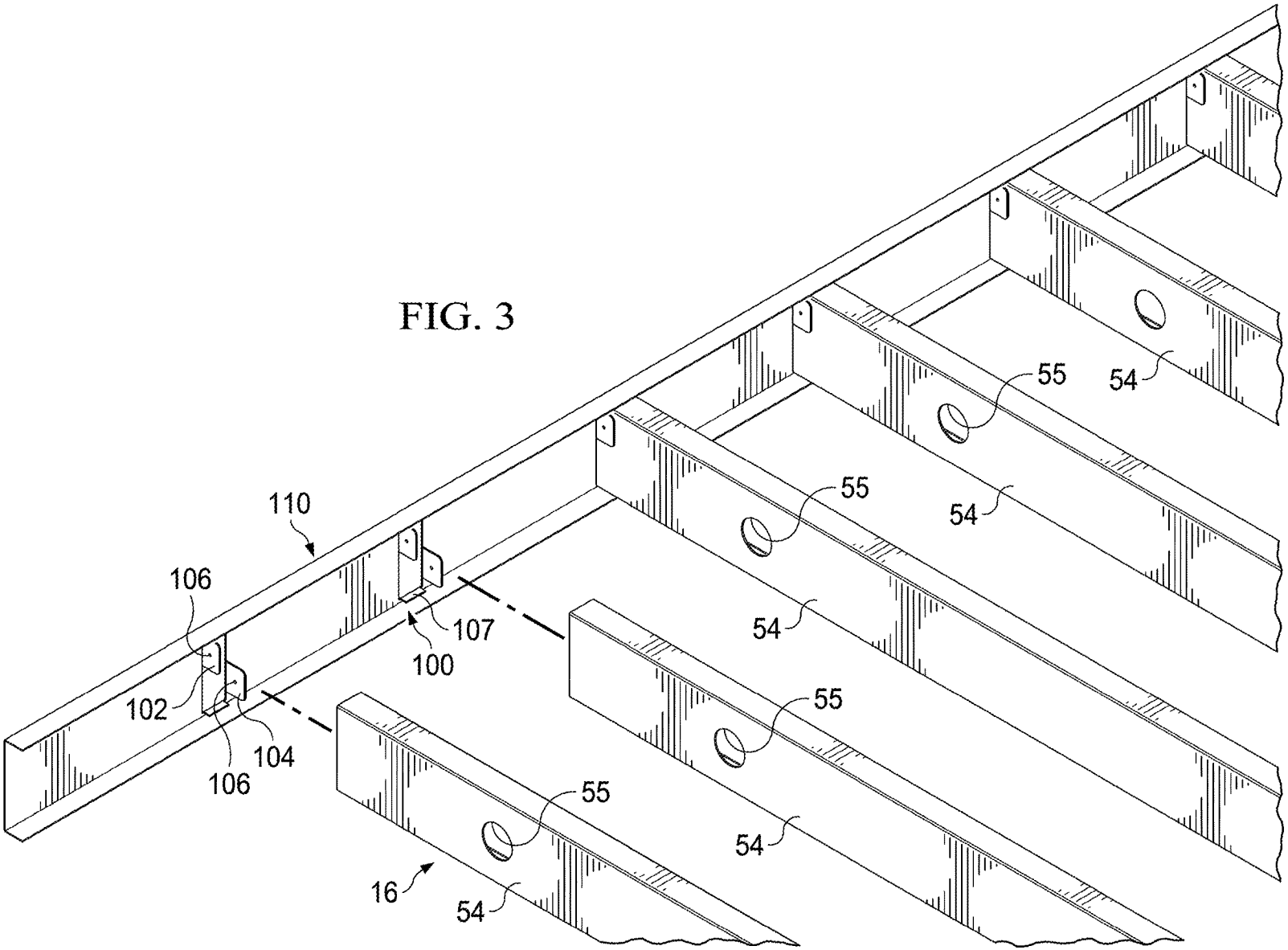
FIG. 3 is an isometric, partially exploded view of an alternate embodiment of a deck framing system according to the teachings of the present disclosure.

Reference is now made to FIG. 3, which is an isometric partially exploded view of the assembly of the floor support joists 16 with an alternate embodiment of a perimeter support member, such as a tabbed rim joist 110. The floor support joist 16 is received between the upper attachment tab 102 and the lower attachment tab 104, and the attachment tabs 102, 104 are secured to the lateral walls 54 of the floor support joist 16. According to one embodiment, the tabbed rim joist 110 attaches to an end of the plurality of floor support joists 16 opposite the end that is attached to the ledger 12. The tabbed rim joist 110 forms a clean perimeter surface of a deck frame (see FIG. 8).

According to an alternate embodiment, the tabbed rim joist 110 includes a pair of horizontal tabs 107, 109 that are received within an opening in an end of the floor support joists 16. Similar to as described above with respect to the ledger 12, the horizontal tabs 107, 109 fit snuggly within the opening to further stabilize the attachment of the joist 16 with the tabbed rim joist 110. Contact between the inner surfaces of the lateral walls 54 of the joists 16 with the lower and upper horizontal tabs 107, 109 inhibit a tendency for the joists 16 to rotate as the lower and upper vertical attachment tabs 102, 104 are secured to the lateral walls 54 of the joists 16. Thus, the presence of the horizontal tabs 107, 109 may make attachment of the upper and lower vertical attachment tabs 104, 102 to each joist 16 easier.

FIGS. 4A-4E illustrate various views of embodiments of the tabbed rim joist 110. The tabbed rim joist 110 is similar to the upper u-shaped portion of the ledger 12. The tabbed rim joist 110 is u-shaped in profile. The u-shape is formed by the web wall 26, the joist support wall 22, and the overhang 24, where the overhang 24 and the joist support wall 22 extend perpendicularly from the web wall 26 in the same direction.

Joist attachment features 100 are disposed spaced apart equidistant along the length of the web wall 26. The joist attachment features 100 may be spaced apart any suitable dimension, for example 8-24 inches, depending on the desired spacing of floor support joists 16. According to certain embodiments, the joist attachment features 100 are spaced apart approximately 12 inches, or 16 inches, or 18 inches. Each joist attachment feature 100 includes an upper vertical joist attachment tab 102 and a lower vertical joist attachment tab 104, similar to the embodiments of the ledger 12 described above in connection with FIGS. 2A-2F. In addition, according to an alternate embodiment, each attachment feature 100 may also include a lower horizontal tab 107 and an upper horizontal tab 109. The upper vertical joist attachment tab 102 is bent at least 90° from the slot 28. The lower vertical joist attachment tab 102 is also bent an angle θ out from the slot 28. According to one embodiment, θ is in a range of 60°-90°, for example approximately 80° degrees.

Figure 4A:
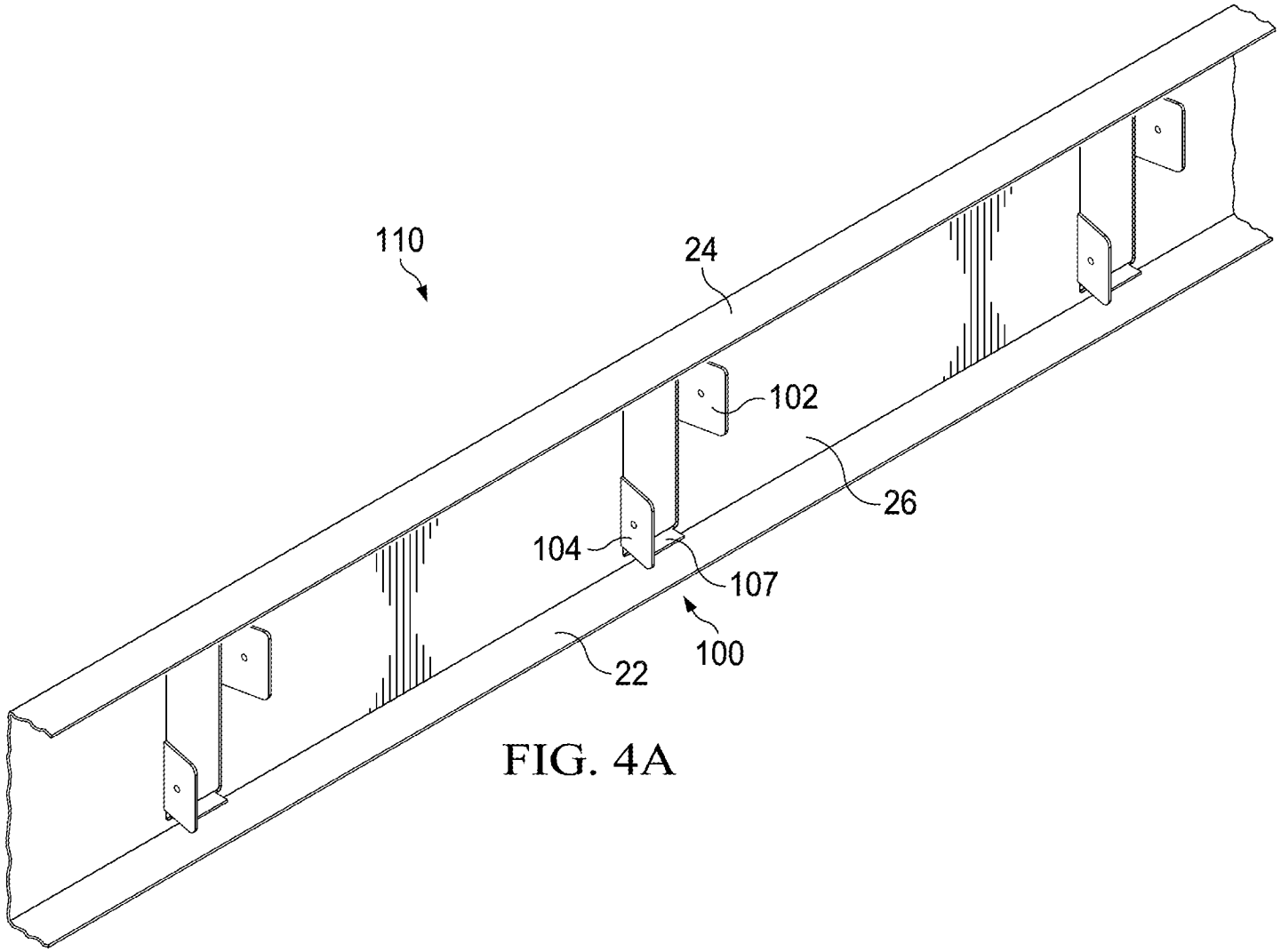
FIGS. 4A-4E are various views of a tabbed rim joist according to the teachings of the present disclosure.
Figure 4B:
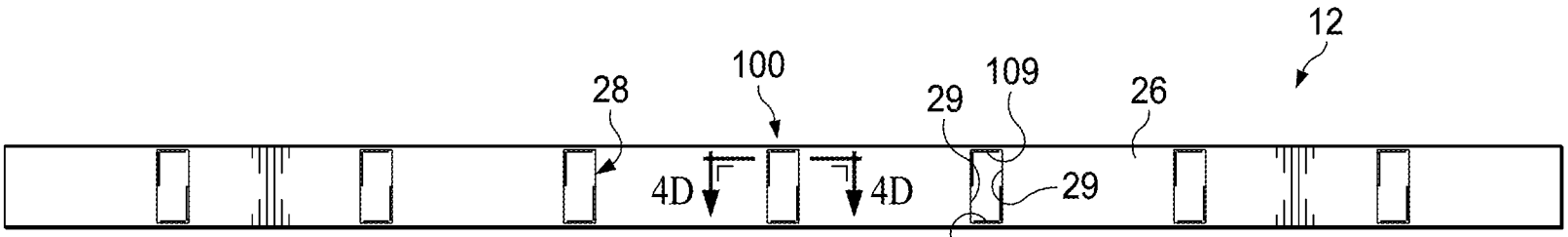
Figure 4E:
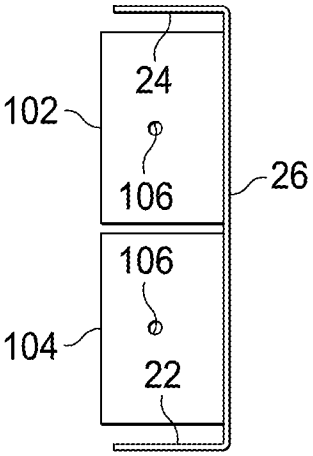
Figure 4D:
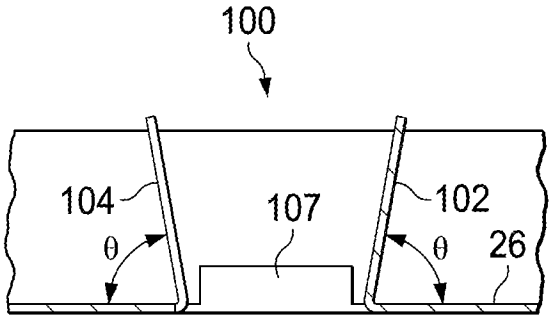
Figure 4C:
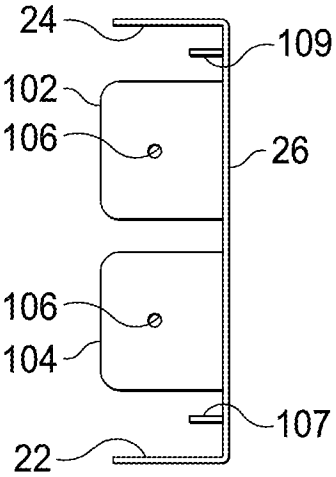

FIG. 4E shows a side, elevation view of an embodiment of the rim joist 110 without the horizontal tabs 107, 109. FIGS. 4A-4D are various views of an embodiment of the rim joist 110 that includes the horizontal tabs 107, 109.

Each attachment feature 100 includes a slot 28, an upper attachment tab 102, and a lower attachment tab 104, and optionally lower and upper horizontal tabs 107, 109. The slot 28 is defined by a pair of opposed lateral edges 29 and a pair of opposed upper and lower edges. The upper attachment tab 102 extends from one lateral edge 29 on one side of the slot 28, and the lower attachment tab 104 extends from the other lateral edge 29, opposite the first lateral edge, of the slot 28. The lower horizontal tab 107 extends from the lower edge of the slot 28, and the upper attachment tab 109 extends from the upper edge of the slot 28.

The upper vertical attachment tab 102 is disposed spaced apart from the lower vertical attachment tab 104 in a first direction 103 on the opposite side of the slot 28. The upper vertical attachment tab 102 has a length measured from the web wall 26 that is generally equal to the width of the slot 28. A height of the upper vertical attachment tab 104 is generally equal to half the height of the slot 28. The lower vertical attachment tab 104 also has a length that is generally equal to the width of the slot 28 measured from the web wall 26. The lower vertical attachment tab 102 is generally equal to half the height of the slot 28. The lower vertical attachment tab 104 is disposed spaced apart from the first vertical attachment tab 102 in a second direction 105.

For example, upper vertical attachment tab 102 may be spaced apart from lower vertical attachment tab 104 approximately a distance of 0.05-0.5 inches, for example 0.35 inches, which corresponds to a dimension of a shearing tool used to form the sheet metal. According to one embodiment, the upper and lower vertical attachment tabs 102, 104 have a height of 1-3 inches, for example approximately 2.2 inches, and a length extending from the web wall 26 of 1-3 inches, for example approximately 2.2 inches.

According to an alternate embodiment that includes lower and upper horizontal tabs 107, 109, a length of the lower horizontal tab 107 together with the height of the lower vertical attachment tab 102 equals approximately half the height of the slot 28. For example, the height of the lower vertical attachment tab 102 is approximately 1.4 inches and the length of the lower horizontal tab 107 is approximately 0.3 inches. The dimensions of the slot 28 and the attachment tabs 102, 104 are selected to accommodate a width of a floor support joist 16.

According to one embodiment, the lower horizontal tab 107 extends from the lower edge of the slot 28, and the upper horizontal tab 109 extends from the upper edge of the slot 28. The horizontal tabs 107, 109 may extend 0.2-0.6 inches from the web wall 26, for example 0.3 inches. The distance of extension of the horizontal tabs 107, 109 is sufficient such that the tubular joists 16 receive the tabs 107, 109 within an end opening, and the tabs 107, 109 will not unintentionally slip out and disengage from the floor joist 16. The length of the horizontal tabs 107, 109 is also at least partly determined by the height of the slot 28 and the dimensions of the other elements of the attachment features 100 (i.e. lower and upper horizontal attachment tabs 102, 104), which are formed from the web wall 26 that is removed and/or bent to form the slot 28.

In one embodiment, the web wall 26 has a height of approximately 6 inches, a slot 28 with a height of approximately 6 inches, and two vertical attachment tabs 102, 104. According to alternate embodiments, a web wall 26 may have a height greater than six inches, for example 8, 10, or 12 inches. A web wall 26 with a greater height may support a slot 28 with a greater height, and thereby may include more than two vertical attachment tabs 102, 104. For example, a web wall having a height of 10 inches may include a slot 28 having a height of approximately 10 inches. More than one vertical attachment tab, for example one vertical attachment tab may extend from one side of the slot 28, and two vertical attachment tabs may extend from the other side of the slot 28. The one attachment tab is disposed vertically between the two attachment tabs on the other side of the slot 28. Similarly, a 12 inch tall web wall 26 and slot 28 may support four vertical attachment tabs, two on each side of the slot 28, in a vertically staggered arrangement. This disclosure contemplates rim joists 110 having other sizes of web walls 26 and slots 28, for example, 8 inches or more than 12 inches or less than 6 inches. A rim joist 110 with a larger web wall 26 supports correspondingly taller joists 16, and thereby the load that can be carried by the deck frame 10 is also increased.

Figure 5:
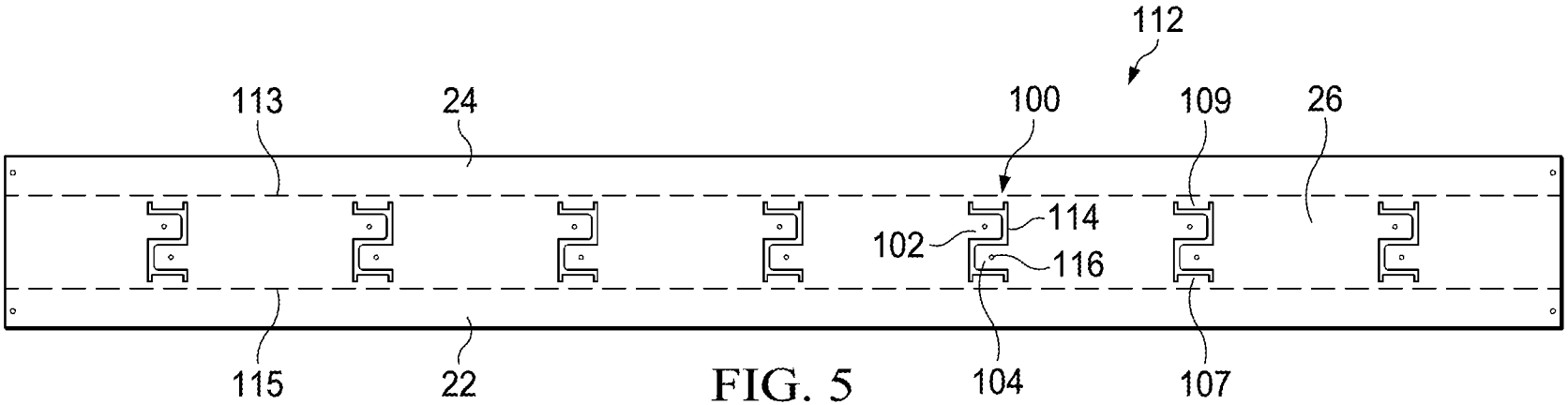
FIG. 5 is an illustration of a tabbed rim joist blank showing cut-out lines to form the tabbed rim joist shown in FIGS. 4A-4D.

FIG. 5 illustrates a front elevation view of a blank 112 with markings for the joist attachment features 100. For simplicity, only the rim joist 110 is illustrated, but one skilled in the art will recognize that the marking for the joist attachment features 100 will be the same for the formation of the ledger 12. Cut marks 114 are shown in a reverse s-shape equally spaced apart along the web wall portion of the blank 112. The cut marks 114 indicate the location a metal forming tool pierces the blank 112 to create the outline of the upper and lower vertical attachment tabs 102, 104, and optionally the lower and upper horizontal tabs 107, 109. The forming tool may also simultaneously stamp or punch the fastener holes 106 with piercing the blank 112 to form the attachment tabs 102, 104.

After piercing the blank 112 according to the cut marks 114, the partially separated portions are bent out from the blank 112 to form the joist vertical attachment tabs 102, 104, and optionally the horizontal tabs 107, 109, and the slot 28. Additional metal forming operations, such as roll forming or brake forming, or otherwise bending portions of the blank 112 along broken line 113 form the overhang 24 and along the broken line 115 form the joist support wall 22. Such bending operations may be performed before or after the attachment features 100 are formed. According to one embodiment, the fastener holes 106 are stamped or drilled in the location of the drill marks 116 prior to cutting and forming the joist vertical attachment tabs 102, 104, and optionally the horizontal tabs 107, 109. Alternatively, as described above, the fastener holes (and thus the drill marks 116) may be omitted.

Reference is now made to FIGS. 6A-6D along with FIGS. 1B and 1C, which are multiple views of the joist bracket 14 according to the teachings of the present disclosure. The joist bracket 14 allows a floor support joist 16 to be received in perpendicular orientation with respect to the ledger 12. In other words, the square joist bracket 14 supports a tube joist 16 in square alignment with the ledger 12.

The joist bracket 14 includes a pair of wing walls 32 and a joist support portion 34. The joist support portion 34 is received through the bracket slot 28 to extend beyond a front surface of the web wall 26 of the ledger 12, and the wings engage a rear surface of the web wall 26. The joist support portion 34 extends approximately three inches from the web wall 26 of the ledger 12. In this manner, the joist bracket 14 may be secured to the ledger 12 without using fasteners as are used in conventional deck framing systems. In particular, an expanding spring force created by compressing opposed lateral portions 36 of the joist bracket 14 toward each other provides a force against the ledger 12 to secure the joist bracket 14 to the ledger 12 without additional fasteners. Moreover, the wings 32 of the joist bracket 14 are disposed between the structure and the ledger 12 and therefore the structure also serves to hold the joist bracket 14 in place within the bracket slot 28 of the ledger 12.

The pair of opposed lateral walls 36 are each delimited at one end by a wing 32 and delimited at an opposite end by an angled wall 38. Each angled wall 38 is delimited at one end by a lateral wall 36 and at an opposite end by a bracket web 40. According to certain embodiments, the bracket web 40 is generally parallel to the web wall 26 of the ledger 12.

Figure 6A:
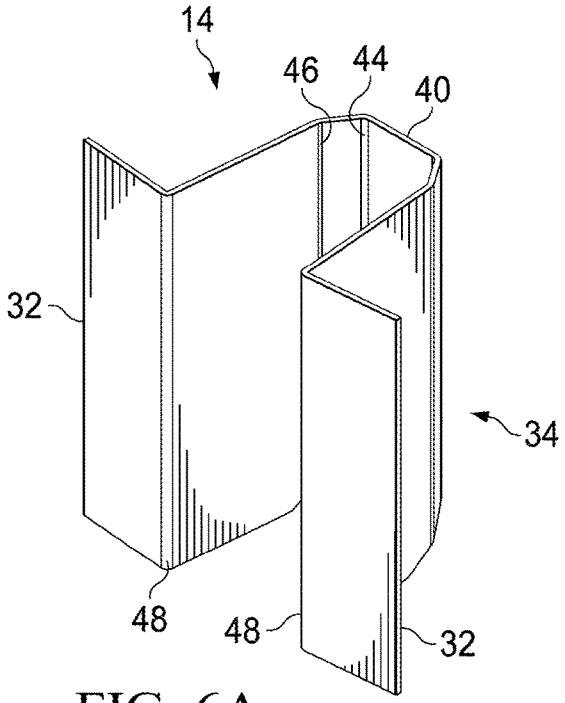
FIGS. 6A-6D are various views of a joist support bracket of the deck framing system shown in FIGS. 1A-1C.
Figure 6B:
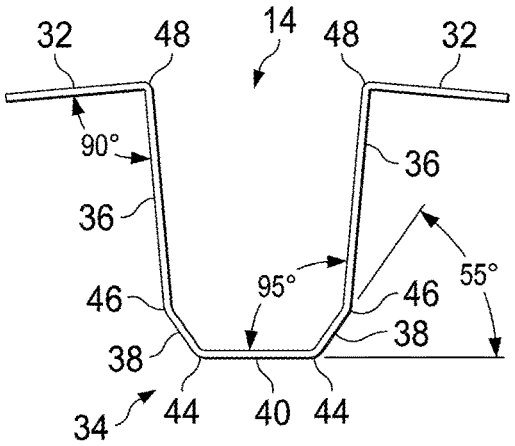
Figure 6C:
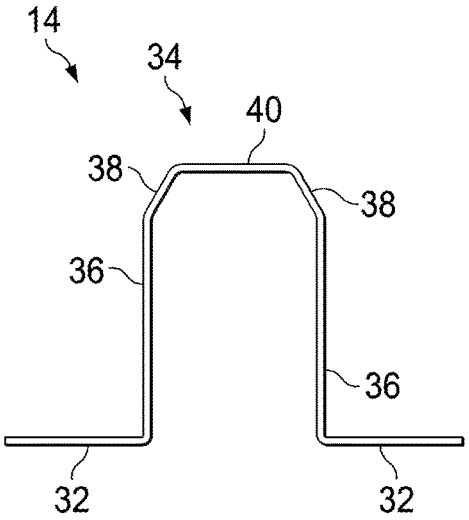

Reference is made to FIG. 6B, which is a top view of the square joist bracket 14 in a relaxed configuration. In the relaxed configuration, the opposed lateral walls 36 are not parallel to each other. Rather, an angled extension of approximately ten degrees from parallel creates a spring force to secure the joist bracket 14 within the bracket slot 28 in the ledger 12. Reference is made to FIG. 6C, which illustrates a top view of the joist bracket 14 in a compressed configuration. In the compressed configuration, the lateral walls 36 of the joist bracket 14 are held compressed by the walls of the bracket slot 28 of the ledger 12 to be parallel to each other. The lateral walls 36 are biased toward their expanded relaxed configuration and thereby create a force against the walls of the bracket slot 28 in the ledger 12.

Figure 6D:
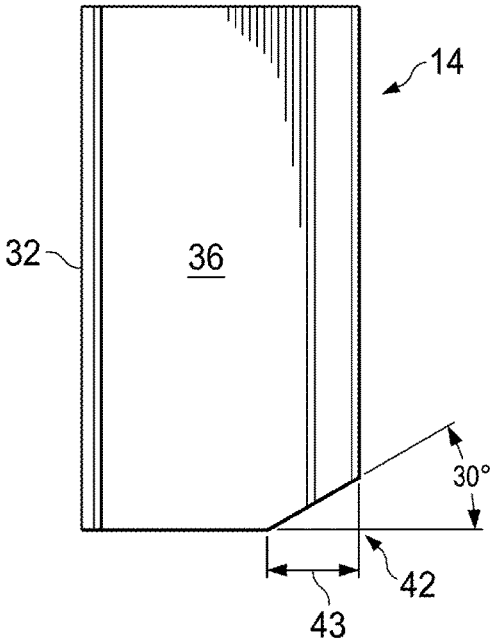
Figure 7A:
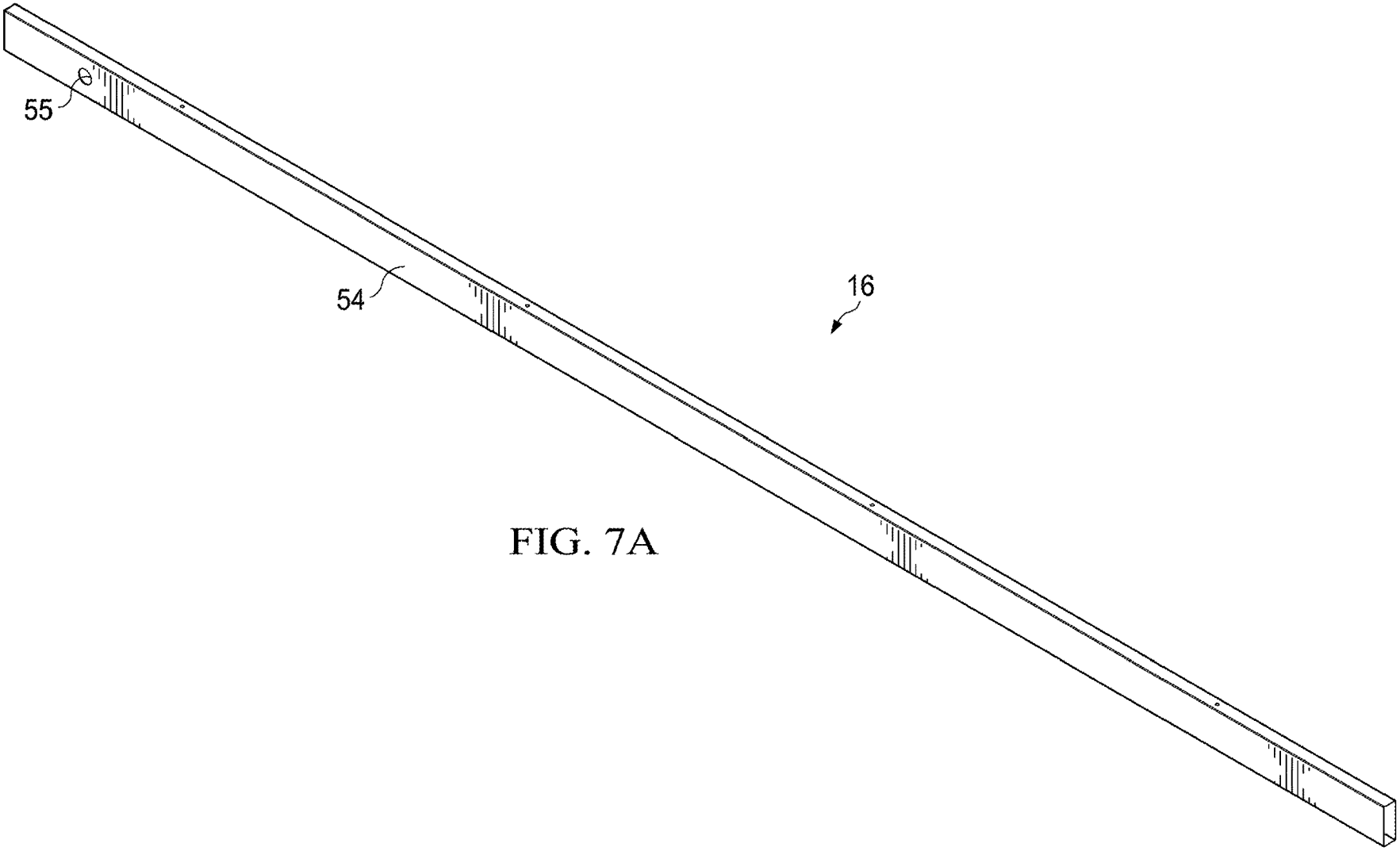
FIGS. 7A-7E are various views of a tubular floor support joist of the deck framing system according to the teachings of the present disclosure.
Figure 7B:
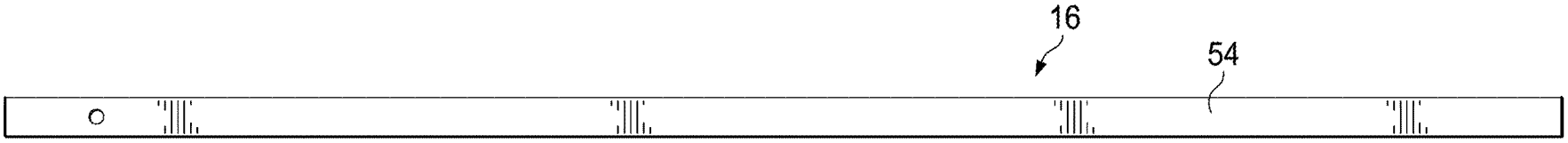
Figure 7C:
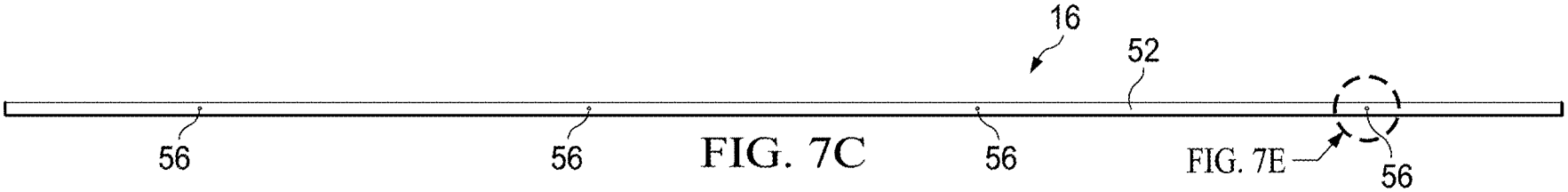
Figure 7E:
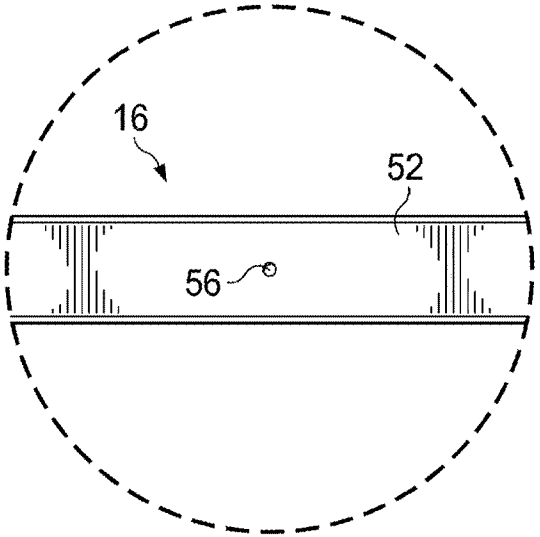
Figure 7D:
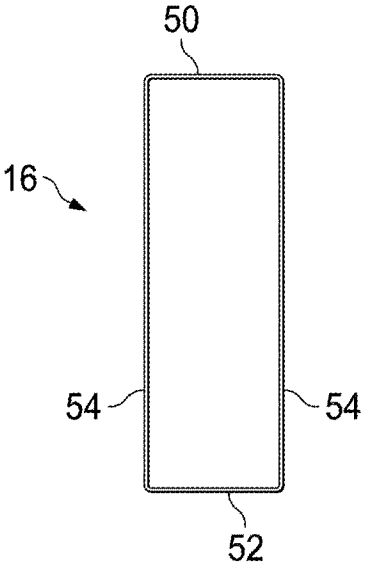

Reference is made to FIG. 6D, which illustrates a side view of the square joist bracket 14. A lower cut-away 42 is formed by removing material from a lower portion of the bracket web 40, the angled walls 38, and the lateral walls 36. According to certain embodiments, the cut-away 42 is approximately thirty degrees from horizontal and extends into the joist bracket 14 a distance 43 of approximately one inch. As described in more detail below, the cut-away 42 facilitates placement of the joist 16 over the joist support portion 34 of the joist bracket 14.

According to one embodiment, the joist bracket 14 has a height of slightly less than six inches such that it fits within the bracket slot 28 of the ledger 12. Alternatively, the joist support bracket 14 may have a height of approximately 8, 10, or 12 inches corresponding to a height of the web wall 26 of the ledger 12.

The joist support bracket 14 is formed by folding a flat piece of sheet metal having a thickness in a range of 0.05-0.10 inches, for example 0.08 inches to form the joist bracket 14 in the relaxed configuration shown in FIG. 6B. The sheet metal is folded along an angled portion fold line 44 approximately 55 degrees with a radius of approximately 0.1 inches to form the angled wall 38. The sheet metal is folded along a pair of lateral portion fold lines 46 approximately thirty degrees to form the lateral walls 36. The sheet metal is folded an opposite direction of the other folds along a pair of wing fold lines 48 to approximately ninety degrees to create the wings 32.

Reference is now made to FIG. 7A-7E, which illustrate various views of the floor support joist or tube joist 16. The joist 16 is generally box shaped and rectangular in profile. The joist 16 may be a generally closed box shape with open ends opposite each other. The joist 16 includes a deck support wall 50 and a lower wall 52 opposite the deck support wall 50. A pair of opposed lateral walls 54 span between the deck support wall 50 and the lower wall 52. According to one embodiment, at one end of the tube joist 16 a through hole 55 is formed through the pair of opposed lateral walls 54. Plumbing lines, electrical wires, data wires, and the like may be run through the through holes 55 to conveniently dispose such lines safely beneath the surface of the deck without additional brackets etc. Alternatively, the through hole 55 may be omitted.

According to certain embodiments, a plurality of weep holes 56 are formed in either the deck support wall 50, the lower wall 52 or both. The weep holes 56 are large enough to allow moisture to drain through the weep holes 56 and out of the interior of the joist 16. According to one embodiment, a twenty foot joist 16 may include four weep holes 56 equally spaced apart from each other approximately sixty inches where the weep holes 56 are formed in the lower wall 52 such that gravity causes moisture from the interior of the joist 16 to drain out of the weep holes 56. The joist 16 has a height of approximately six inches, which allows it to fit snuggly over the joist bracket 14 and between the overhang wall 24 and the joist support wall 22 of the ledger 12. Alternatively, as discussed above, the joist 16 may have a height of 8, 10, or 12 inches corresponding to a height of the web walls 16 of the ledger 12 and the rim joist 110.

The box-shape of the joist 16 results in a joist that is stronger than a conventional c-shaped metal joist. In assembling the deck framing system 10, the joist 16 is received over the joist support portion 34 of the joist bracket 14. The lower cut-away 42 facilitates ease of placement of the joist 16 during assembly. The lower cut-away 42 allows the joist 16 to be initially placed over the joist support portion 34 at a downward sloping angle from horizontal during initial positioning before the joist 16 is seated over the support portion 34 of the bracket in its assembled horizontal position. Fasteners (not shown) are received through the opposed lateral walls 54 of the joist 16 and the lateral portions 36 of the joist bracket 14 to further secure the joist 16 to the joist bracket 14.

Figure 8:
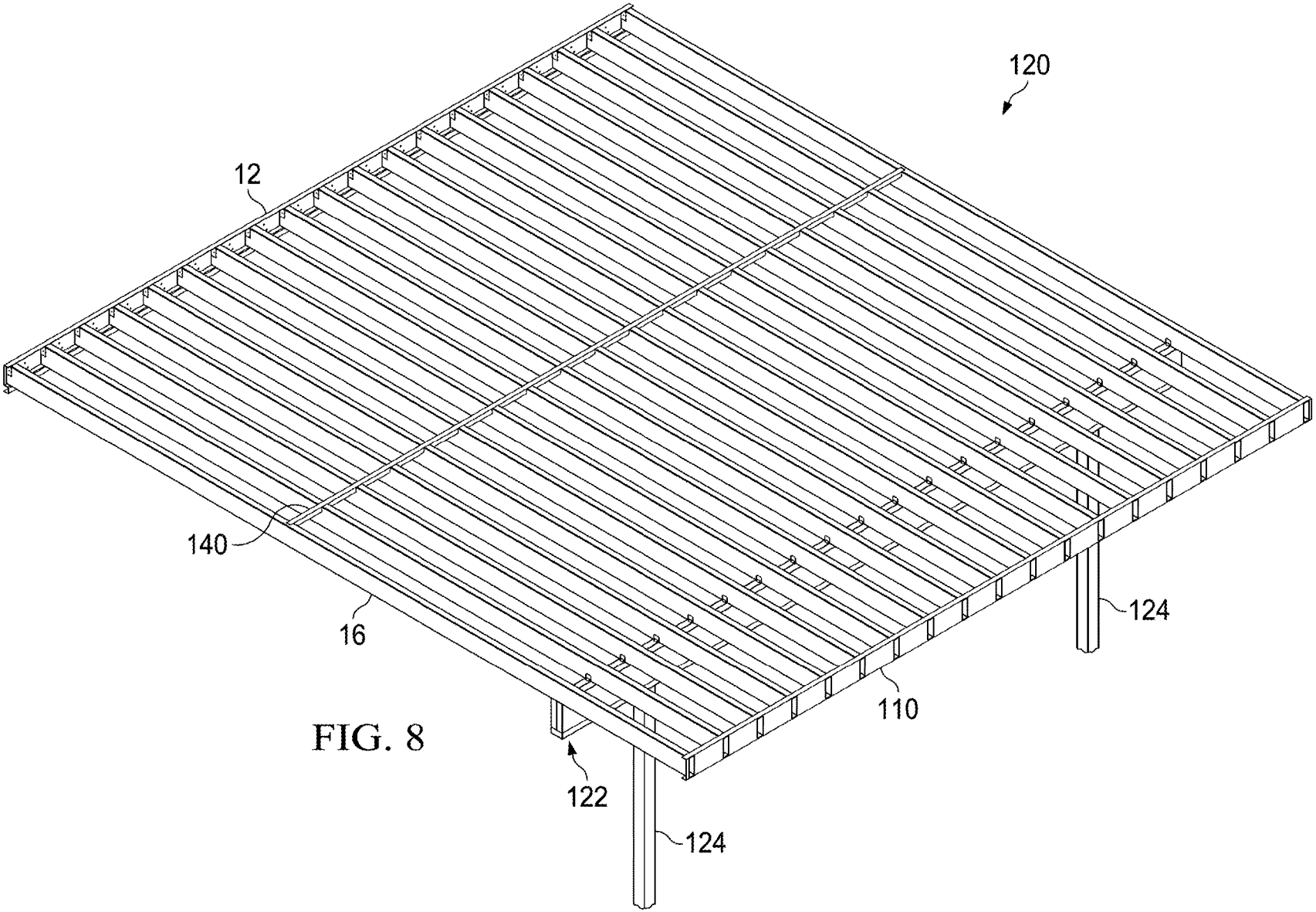
FIG. 8 is an isometric view of an assembled deck frame according to the teachings of the present disclosure.

FIG. 8 is an isometric view of an assembled deck frame 120 according to the teachings of the present disclosure. The tabbed ledger 12 supports the plurality of floor support joists 16 at a first end, and the tabbed rim joist 110 is secured to the plurality of floor support joists 16 at an opposite end. A beam 122 is disposed proximate the tabbed rim joist 110. The beam 122 may be supported by at least one support post 124 (two shown). The beam 122 may be a box-shaped tubular member that generally is configured to support more weight than a single floor support joist 16. A lower surface of the lower wall 52 of each floor support joist 16 rests on an upper surface of the beam 122. Alternatively, the joists 16 may be cut and bracket mounted on the beam 112 such that an upper surface of the joist 16 is generally flush with an upper surface of the beam 122.

Figure 9A:
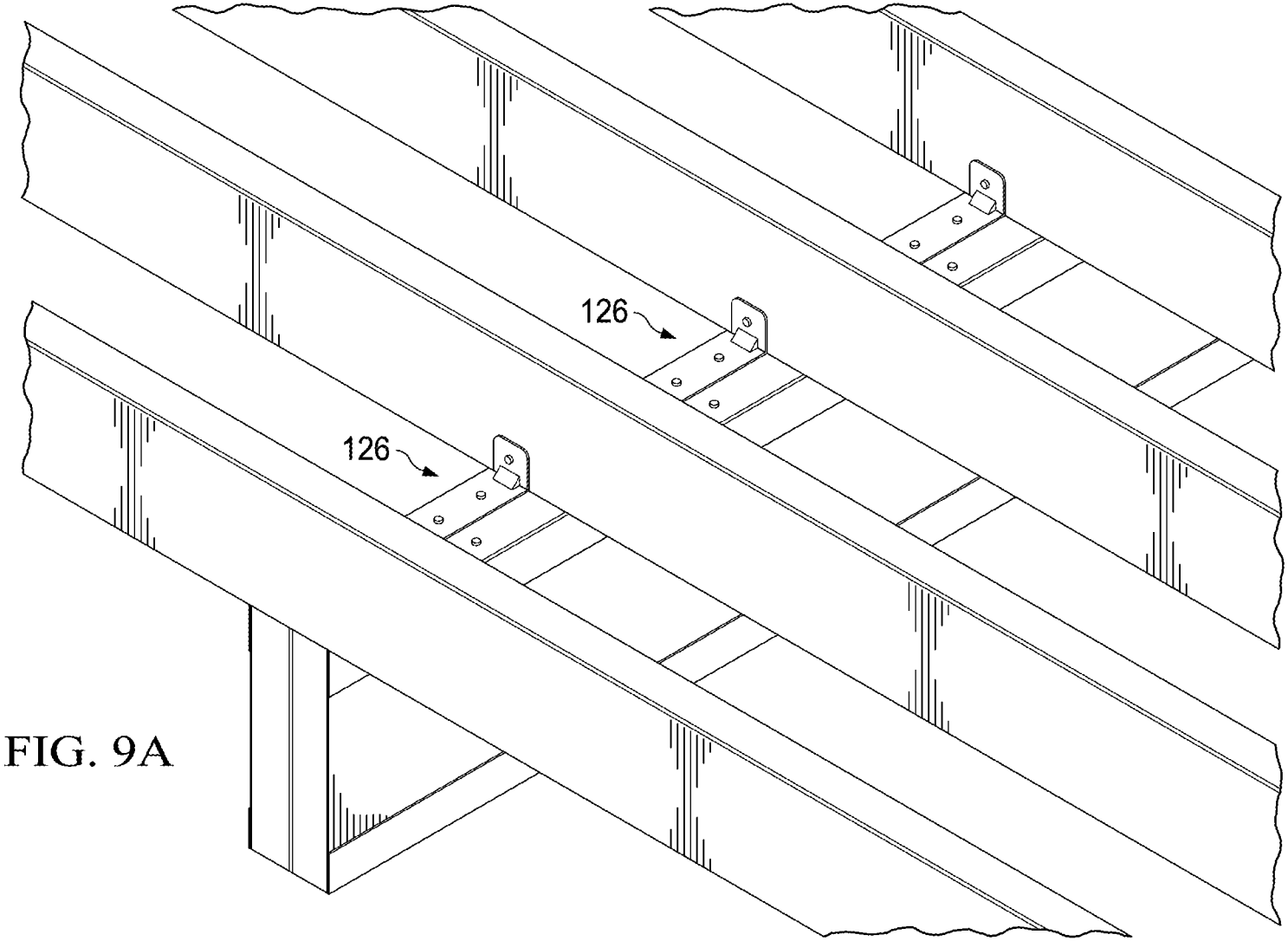
FIGS. 9A-9B are detailed views of the deck frame of FIG. 8 showing blocking members that maintain the lateral spacing between adjacent tubular floor support joists.
Figure 9B:
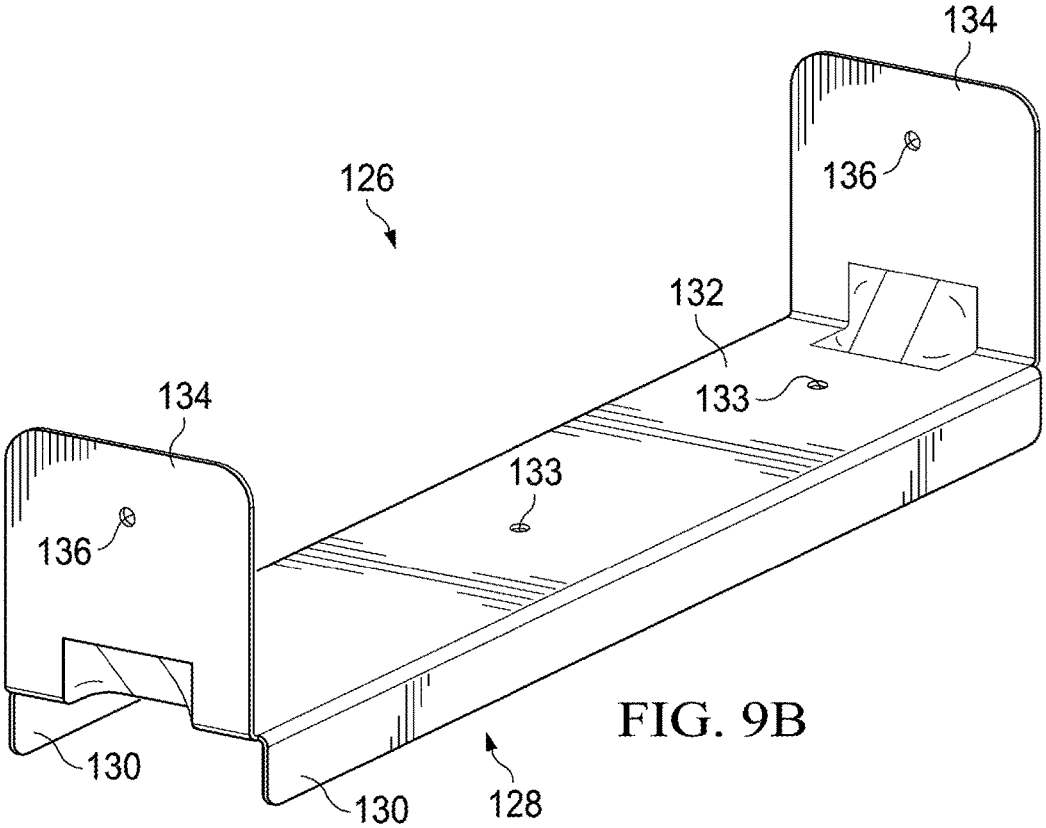

FIG. 9A is an isometric detail view of the junction of the beam 122 and the joists 16. According to one embodiment, lateral spacing between the floor support joists 16 is maintained by a blocking member 126. FIG. 9B is a detail view of the blocking member 126. The blocking member 126 includes a base portion 128 and a pair of opposed base wings 130. The base wings 130 fit over a portion of the beam 122, and a base wall 132 of the base portion 128 receives fasteners through through holes 133 to secure the blocking member 126 to the beam 122. According to an alternate embodiment, the blocking member 126 may include a single base wing 130 or the base wings may be omitted. A single base wing 130 may be beneficial in securing the blocking member 126 to either side of a double beam 122 in the event the full width of the base wall 132 does not span the full width of the beam 122.

A pair of opposed joist attachment wings 134 extend generally perpendicularly from the base portion 128. The joist attachment wings 134 receive a fastener through a through hole 136 to attach the attachment wings 134 to the lateral walls 54 of adjacent floor support joists 16. According to one embodiment, one blocking member 126 is positioned between each joist 16 and an adjacent joist 16. The blocking member 126 maintains the lateral spacing between floor support joists 16 at the junction of the joists 16 and the beam 122. As such, the blocking member 126 may be sized to span between joists 16 separated by any suitable dimension, for example 12 or 16 inches.

Figure 10B:
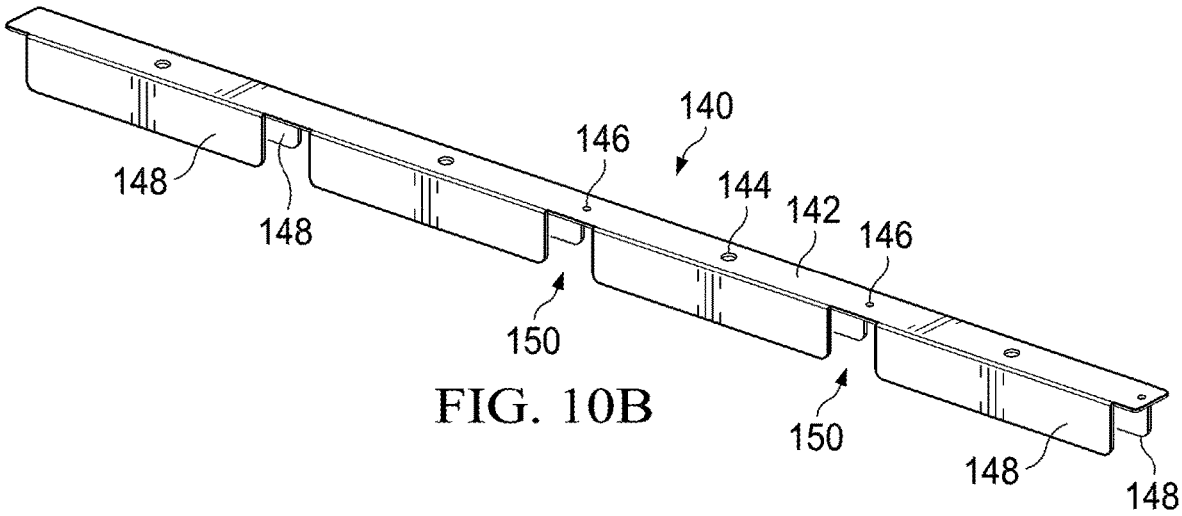
FIGS. 10A-10B are detailed views of the deck frame of FIG. 8 showing blocking straps that maintain the lateral spacing between adjacent tubular floor support joists.
Figure 10A:
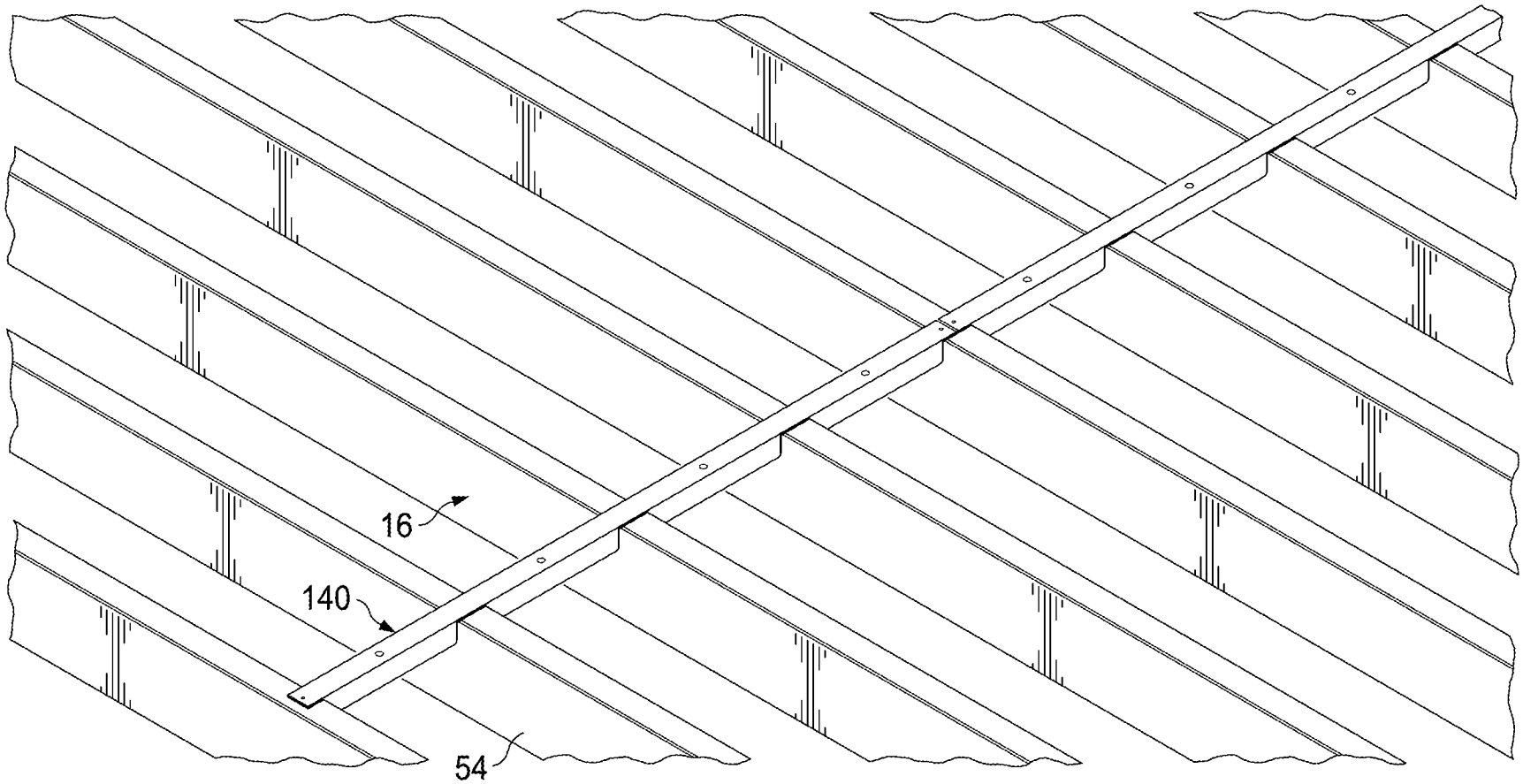

One or more blocking straps 140 maintains the lateral spacing between adjacent floor joists 16 at a location other than the junction of the joists 16 and the beam 122. FIG. 10A is a detail isometric view of a junction of the blocking strap 140 with the floor support joists 16. FIG. 10B is an isometric view of the blocking strap 140. According to one embodiment, the blocking strap 140 includes a base wall 142 extending the length of the blocking strap 140. The base wall 142 is an elongated, flat piece of metal, for example light gauge steel with a thickness in a range of 0.05-0.10 inches, for example 0.08 inches. One or more weep holes 144 is formed in the base wall 142 to allow moisture to drain to avoid it collecting in the blocking strap 140. A plurality of fastener holes 146 are spaced apart along the base wall 142 of the blocking strap 140. The fastener holes 146 are positioned at locations where the base wall 142 is joined to a floor support joist 16.

A plurality of spaced apart pairs of spacer walls 148 extend generally perpendicularly from the base wall 142. The spacer walls 148 are sized to accommodate a particular spacing of floor support joists 16, for example 12 inches, 16 inches, or any other suitable joist spacing dimension. As stated above, the spacing dimension of the floor support joists 16 corresponds to the spacing of the attachment features 100. One spacer wall 148 of each pair is disposed on each side of the blocking strap 140. According to an alternate embodiment, the spacer walls 148 may only extend from one side of the blocking strap 140, or they may be disposed to alternate sides along the length of the blocking strap 140. The spacer walls 148 are generally rectangular-shaped flat metal members. According to one embodiment, the spacer walls 148 are bent from the same piece of light gauge steel that forms the base wall 142.

One pair of spacer walls 148 is spaced apart from an adjacent pair of spacer walls 148 to form a gap 150. The gap 150 accommodates a floor support joist 16. According to one embodiment, a blocking strap 140 includes three gaps 150 to accommodate three adjacent floor support joists 16. On each end of the blocking strap 140 the base wall 142 extends a distance of approximately half a gap 150 further than the spacer walls 148. This extension allows adjacent blocking straps 140 to together form a gap approximately a width of the gap 150 to accommodate a floor support joist 16. According to an alternate embodiment, a blocking strap 140 may include two gaps 150 that each accommodate a joist 16. The two gap blocking strap 140 may be suitable to block joists 16 that are spaced apart approximately 16 inches.

According to one embodiment, the blocking strap 140 is received over a plurality of floor support joists 16 and secured to the floor support portion 50 of the floor support joist 16 by fasteners, such as metal screws, that are received through the fastener holes 146 and penetrate the floor support wall 50 of the floor support joists 16. According to an alternate embodiment, the blocking strap 140 is received under a plurality of floor support joists 16 and is secured to a lower wall 52 of the floor support joists 16 by fasteners received through the fastener holes 146 that penetrate the lower wall 52 of the floor support joists 16.

As shown in FIG. 8, multiple blocking straps 140 are installed in lateral alignment on the deck frame 120 to support the number of floor support joists 16 and maintain the lateral spacing between the floor support joists 16.

The rim joist 110 may optionally be powder coated such that the rim joist 110 may be better protected from the elements that may cause rust or other corrosion, and it has a more pleasing aesthetic appearance over the appearance of galvanized steel. In addition, all components of all embodiments of the deck framing system optionally may be powder coated to improve the appearance of the components over the appearance of galvanized steel including the ledger 12, the tube joists 16, the joist support bracket 14, the blocking members 126, and the blocking straps 140.

Although preferred embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A deck frame, comprising:

at least one perimeter support member comprising a joist support wall, a web wall extending perpendicularly from the joist support wall and an overhang wall extending perpendicularly from the web wall and disposed parallel to the joist support wall, the web wall having a plurality of spaced apart joist attachment features, each one of the plurality of spaced apart joist attachment features comprising:

a slot defined by the web wall and having a width, a first perimeter edge extending a height of the slot, a second perimeter edge disposed opposite the first perimeter edge and extending the height of the slot;

an upper attachment tab extending from the first perimeter edge of the slot a first distance generally equal to the width of the slot at a first angle with respect to the web wall; and a lower attachment tab extending from the second perimeter edge of the slot the first distance and forming a second angle with respect to the web wall; and a first horizontal tab extending from a third perimeter edge of the slot and a second horizontal tab extending from a fourth perimeter edge of the slot; and a plurality of joists each having a first lateral wall and a second lateral wall disposed opposite the first lateral wall, wherein for each joist the upper attachment tab is configured to be secured to the first lateral wall and the lower attachment tab is configured to be secured to the second lateral wall.

2. The deck frame of claim 1 wherein each joist has a hollow box-shape and an open end configured to receive the first and second horizontal tabs.

3. The deck frame of claim 1 wherein the perimeter support member has a u-shape in profile.

4. The deck frame of claim 1 wherein the perimeter support member has an s-shape in profile.

5. The deck frame of claim 1 wherein the width is at least two inches.

6. The deck frame of claim 5 wherein the height is at least 4.5 inches.

7. The deck frame of claim 6 wherein:

the height of each slot is selected from the group consisting of 6.5 inches, 8.5 inches, and 10.5 inches.

8. The deck frame of claim 1 wherein the first angle and the second angle are each in a range of 60°-90°.

9. A perimeter support member, comprising:

a web wall;

a joist support wall extending generally perpendicularly from the web wall, the web wall having a plurality of spaced apart joist attachment features, each one of the plurality of spaced apart joist attachment features further comprising:

a slot defined by the web wall, the slot having a width, a first perimeter edge extending a height of the slot and a second perimeter edge disposed opposite the first perimeter edge and extending the height of the slot;

an upper vertical attachment tab extending from the first perimeter edge a first distance generally equal to the width of the slot at a first angle with respect to the web wall;

a lower vertical attachment tab extending from the second perimeter edge of the slot the first distance and forming a second angle with respect to the web wall;

a first horizontal tab extending from a third perimeter edge of the slot and a second horizontal tab extending from a fourth perimeter edge of the slot; and wherein the first angle and the second angle are each in a range of 60°-90°.

10. The perimeter support member of claim 9 further comprising an overhang wall extending perpendicular from the web wall and disposed spaced apart from the joist support wall.

11. The perimeter support member of claim 10 wherein the perimeter support member has a generally u-shaped profile.

12. The perimeter support member of claim 10 wherein the perimeter support member has a generally s-shaped profile.

13. The perimeter support member of claim 9 wherein the web wall defines a plurality of spaced apart fastener holes configured to receive a fastener to attach the web wall to a support structure.

14. The perimeter support member of claim 9 wherein the width is at least two inches.

15. The perimeter support member of claim 14 wherein the height is at least 4.5 inches.

16. A perimeter support member, comprising:

a web wall;

a joist support wall extending generally perpendicularly from the web wall, the web wall having a plurality of spaced apart joist attachment features, each one of the plurality of spaced apart joist attachment features further comprising:

a slot defined by the web wall, the slot having a width, a first perimeter edge extending a height of the slot and a second perimeter edge disposed opposite the first perimeter edge and extending the height of the slot;

an upper vertical attachment tab extending from the first perimeter edge a first distance generally equal to the width of the slot at a first angle with respect to the web wall;

a lower vertical attachment tab extending from the second perimeter edge of the slot the first distance and forming a second angle with respect to the web wall;

a first horizontal tab extending from a third perimeter edge of the slot; and a second horizontal tab extending from a fourth perimeter edge of the slot opposite the third perimeter edge.

17. The perimeter support member of claim 16 wherein the perimeter support member has a generally u-shaped profile.

18. The perimeter support member of claim 16 wherein the perimeter support member has a generally s-shaped profile.

* * * * *